US009955263B2

(12) United States Patent
Huttunen et al.

(10) Patent No.: US 9,955,263 B2
(45) **Date of Patent: *Apr. 24, 2018**

(54) METHODS, APPARATUSES AND COMPUTER PROGRAM PRODUCTS FOR FACILITATING DIRECTIONAL AUDIO CAPTURE WITH MULTIPLE MICROPHONES

(71) Applicant: NOKIA TECHNOLOGIES OY, Espoo (FI)

(72) Inventors: Anu Hannele Huttunen, Tampere (FI); Jorma Juhani Makinen, Tampere (FI)

(73) Assignee: NOKIA TECHNOLOGIES OY, Espoo (FI)

( * ) Notice: Subject to any disclaimer, the term of this patent is extended or adjusted under 35 U.S.C. 154(b) by 0 days.

This patent is subject to a terminal disclaimer.

(21) Appl. No.: 14/956,005

(22) Filed: Dec. 1, 2015

(65) Prior Publication Data

US 2016/0088392 A1 Mar. 24, 2016

Related U.S. Application Data

(63) Continuation of application No. 13/652,167, filed on Oct. 15, 2012, now Pat. No. 9,232,310.

(51) Int. Cl.
*H04R 5/027* (2006.01)
*H04R 3/00* (2006.01)
(Continued)

(52) U.S. Cl.
CPC ..... *H04R 5/027* (2013.01); *H04R 1/265* (2013.01); *H04R 1/326* (2013.01); *H04R 3/005* (2013.01);
(Continued)

(58) Field of Classification Search
CPC ... G10L 19/008; G10L 21/0208; H04R 3/005; H04R 5/027
(Continued)

(56) References Cited

U.S. PATENT DOCUMENTS 6,507,659 B1 * 1/2003 Iredale ..... H04R 3/005 381/111
7,415,117 B2 8/2008 Tashev et al.
(Continued)

FOREIGN PATENT DOCUMENTS

WO WO 2010/014074 A1 2/2010
WO WO 2012/018445 A1 2/2012

OTHER PUBLICATIONS

Kajala, M., et al., "Broadband Beamforming Optimization for Speech Enhancement in Noisy Environments", In Proceedings of 1999 IEEE Workshop on Applications of Signal Processing to Audio and Acoustics, New Paltz, New York, Oct. 17-20, 1999, pp. 19-22.
(Continued)

*Primary Examiner* — Gerald Gauthier
(74) *Attorney, Agent, or Firm* — Alston & Bird LLP

(57) ABSTRACT

An apparatus for providing directional audio capture may include a processor and memory storing executable computer program code that cause the apparatus to at least perform operations including assigning at least one beam direction, among a plurality of beam directions, in which to direct directionality of an output signal of one or more microphones. The computer program code may further cause the apparatus to divide microphone signals of the microphones into selected frequency subbands wherein an analysis performed. The computer program code may further cause the apparatus to select at least one set of microphones of the apparatus for selected frequency subbands. The computer program code may further cause the apparatus
(Continued)

to optimize the assigned at least one beam direction by adjusting a beamformer parameter(s) based on the selected set of microphones and at least one of the selected frequency subbands. Corresponding methods and computer program products are also provided.

41 Claims, 19 Drawing Sheets

(51) Int. Cl.
*H04R 1/26* (2006.01)
*H04R 1/32* (2006.01)

(52) U.S. Cl.
CPC .... *H04R 2201/405* (2013.01); *H04R 2203/12* (2013.01); *H04R 2430/03* (2013.01)

(58) Field of Classification Search
USPC ..... 340/13.34, 902; 348/14.08; 455/575.6; 600/25; 702/190; 379/406.02, 454; 381/26, 71.1, 71.11, 86, 92, 94.1, 94.3, 381/94.9, 300, 313
See application file for complete search history.

(56) References Cited

U.S. PATENT DOCUMENTS 7,697,698 B2 * 4/2010 Brown ..... B60Q 5/00 340/435
7,756,278 B2 * 7/2010 Moorer ..... H04R 1/406 381/111
7,885,688 B2 2/2011 Thornton et al.
7,970,123 B2 * 6/2011 Beaucoup ..... H04M 9/085 379/406.02
8,094,040 B1 * 1/2012 Cornett ..... G08G 1/087 340/902
8,194,872 B2 6/2012 Buck et al.
8,391,523 B2 3/2013 Biundo Lotito et al.
8,666,090 B1 * 3/2014 Townsend ..... H04R 3/005 381/111
8,686,837 B2 * 4/2014 Larsen ..... G08C 23/04 340/13.24
9,445,193 B2 * 9/2016 Tico ..... G10L 21/0208
9,472,201 B1 * 10/2016 Sleator ..... H04R 3/00
9,635,457 B2 * 4/2017 Nowak ..... H04R 3/005
2002/0041695 A1 * 4/2002 Luo ..... H04R 3/005 381/313
2003/0097037 A1 * 5/2003 Miller ..... H04R 25/43 600/25
2003/0160862 A1 * 8/2003 Charlier ..... H04N 5/23238 348/14.08
2004/0013038 A1 1/2004 Kajala et al.
2005/0009583 A1 * 1/2005 Cheung ..... H04S 1/00 455/575.6
2005/0141731 A1 * 6/2005 Hamalainen ..... H01Q 3/2605 381/94.3
2005/0195988 A1 * 9/2005 Tashev ..... H04R 3/005 381/92
2005/0201551 A1 * 9/2005 Dedieu ..... H04M 1/03 379/454
2006/0222187 A1 * 10/2006 Jarrett ..... H04R 3/002 381/92
2006/0253282 A1 * 11/2006 Schmidt ..... G07C 5/0808 704/233
2008/0226098 A1 * 9/2008 Haulick ..... G10L 21/0208 381/94.9
2008/0288219 A1 * 11/2008 Tashev ..... H04B 7/0854 702/190
2009/0003634 A1 * 1/2009 Kushida ..... H04R 1/403 381/300
2009/0313028 A1 12/2009 Tammi et al.
2010/0177908 A1 * 7/2010 Seltzer ..... H04R 3/005 381/92
2011/0033063 A1 * 2/2011 McGrath ..... H04R 3/005 381/92
2011/0058683 A1 * 3/2011 Kosteva ..... H04R 3/005 381/92
2011/0075858 A1 * 3/2011 Chihara ..... H04R 3/005 381/92
2011/0096136 A1 * 4/2011 Liu ..... H04N 7/144 348/14.07
2011/0103614 A1 * 5/2011 Cheung ..... H04R 1/403 381/94.1
2011/0135117 A1 6/2011 Nystrom et al.
2011/0200205 A1 * 8/2011 Tokuda ..... G10L 21/0208 381/92
2012/0076316 A1 * 3/2012 Zhu ..... H04R 3/005 381/71.11
2012/0120222 A1 * 5/2012 Lettow ..... G02B 21/24 348/79
2012/0120223 A1 * 5/2012 Zuest ..... G02B 21/0008 348/79
2012/0320143 A1 * 12/2012 Chu ..... H04N 7/15 348/14.08
2013/0101141 A1 * 4/2013 McElveen ..... H04S 3/002 381/123
2014/0105416 A1 * 4/2014 Huttunen ..... H04R 5/027 381/92
2015/0172811 A1 * 6/2015 Sassi ..... H04R 3/002 381/71.1
2016/0044410 A1 * 2/2016 Makinen ..... H04R 1/406 381/26
2016/0275962 A1 * 9/2016 Huttunen ..... G10K 11/178
2016/0284355 A1 * 9/2016 Makinen ..... G10L 19/008

OTHER PUBLICATIONS

Mihov, S. G., et al., "Enhanced Sound Capture System for Small Devices," In Proceedings of XLIII International Scientific Conference on Information, Communication, and Energy Systems and Technologies ICEST 2008, Jun. 2008, 4 pages, retrieved from <http://research.microsoft.com/apps/pubs/default.aspx?id=76770>, Serbia.
United States Patent and Trademark Office, Office Action for U.S. Appl. No. 13/652,167, Mar. 17, 2015, 7 pages, U.S.A.
United States Patent and Trademark Office, Notice of Allowance for U.S. Appl. No. 13/652,167, Sep. 2, 2015, 5 pages, U.S.A.

* cited by examiner

METHODS, APPARATUSES AND COMPUTER PROGRAM PRODUCTS FOR FACILITATING DIRECTIONAL AUDIO CAPTURE WITH MULTIPLE MICROPHONES

CROSS-REFERENCE TO RELATED APPLICATIONS

This application is a continuation of U.S. application Ser. No. 13/652,167, filed Oct. 15, 2012, the contents of which are hereby incorporated herein in its entirety by reference.

TECHNOLOGICAL FIELD

An example embodiment of the invention relates generally to audio management technology and, more particularly, relates to a method, apparatus, and computer program product for capturing one or more directional sound fields in communication devices.

BACKGROUND

The modern communications era has brought about a tremendous expansion of wireline and wireless networks. Computer networks, television networks, and telephony networks are experiencing an unprecedented technological expansion, fueled by consumer demand. Wireless and mobile networking technologies have addressed related consumer demands, while providing more flexibility and immediacy of information transfer.

Current and future networking technologies continue to facilitate ease of information transfer and convenience to users. Due to the now ubiquitous nature of electronic communication devices, people of all ages and education levels are utilizing electronic devices to communicate with other individuals or contacts, receive services and/or share information, media and other content. One area in which there is a demand to increase ease of information transfer relates to the delivery of services to communication devices. The services may be in the form of applications that provide audio features. Some of the audio features of the applications may be provided by microphones of a communication device.

At present, the positions of the microphones in a communication device such as a mobile device may be limited which may create problems in achieving optimal audio output. Currently, some existing solutions address these problems by utilizing beamforming technology to produce beams to facilitate directional audio capture.

The directional beam quality may be determined by the number and locations of the microphones of a communication device used to construct the beams. However, the possible microphone positions may be limited, for example, in a mobile device. As such, the microphones may not necessarily be placed to achieve optimal beamforming. As one example, in a mobile device such as a mobile phone or a tablet computer, one side of the mobile device may be mostly covered by a screen, where microphones may be unable to be placed.

Furthermore, the microphones are usually placed to optimize the functioning of other applications. For example, in a mobile phone there may be a microphone for telephony usage, another microphone for active noise cancellation, and another microphone for audio capture related to video recording. The distance between these microphones may be too large for the conventional beamforming approach since the aliasing effect may take place in an instance in which the distance of the microphones is larger than half the wavelength of sound. This may limit the frequency band of operation for a beamformer. For example, in an instance in which there are two microphones that are located in the opposite ends of the mobile phone, their mutual distance may be several centimeters. This may limit the beamformer usage to low frequencies (for example, for a microphone distance of 10 centimeters (cm), the theoretical limit of the beamformer usage is less than 1.7 kilo hertz (kHz) in the frequency domain). As such, at present, the positions of microphones in communication devices may be too far apart which may cause problems in forming beams to achieve optimal audio.

SUMMARY

A method, apparatus and computer program product are therefore provided for capturing a directional sound field(s) in one or more communication devices. For instance, an example embodiment may utilize a beamforming technology with array signal processing for capturing a directional sound field(s). By utilizing array signal processing, an example embodiment may capture sound field(s) in a desired direction while suppressing sound from other directions.

In an example embodiment, a communication device may include several microphones. These microphones may be placed concerning applications including, but not limited to, telephony, active noise cancellation, video sound capture (e.g., mono), etc. The positions of the microphones may also be influenced by the communication device form factor and design. In one example embodiment, the microphones that are already available or included in the communication device (e.g., a mobile device) may be utilized for directional sound capture using array processing. As such, it may not be necessary to add more microphones specifically for a directional sound capture application(s), and still, good directional sound quality may be attained. As described above, there may be several microphones available in a communication device. An example embodiment may optimize the directional audio capture using these microphones in a novel beamforming configuration.

As such, an example embodiment may utilize microphones that may not be optimally placed regarding array processing. As a consequence, there are three main issues taken into account by some example embodiments. Firstly, the distance between microphones may not be optimal for beamforming. Secondly, the assumption of propagation in a lossless medium may not be valid. The mechanics of a communication device such as, for example, a smartphone may shadow the audio signal differently for different microphones which may depend on the propagation direction. Thirdly, as described above, using existing microphones, it may be challenging to design a beamformer that would have an acceptable directional response for all the required frequencies.

As such, in the design of the directional recording a new approach is adopted by an example embodiment. Firstly, in an example embodiment, the microphone signals may be divided into subbands (for example, to produce subband signals). Secondly, an example embodiment may optimize the beamformer parameters separately and independently for each frequency subband and each directional sound field. Thirdly, in an example embodiment, the optimization may be done in an iterative manner using measurement data.

An example embodiment may solve the issues that are caused by the unoptimal microphone placement. For instance, a first issue may be that the distance between the microphones limits the applicable frequency range for the beamformer. In this regard, for each frequency subband, an example embodiment may choose the best possible set of microphones. For example, microphones positioned in the ends of a communication device (e.g., a mobile device) may be used in a low frequency domain taking into account a restriction posed by the aliasing effect. In an example embodiment, the microphones with a smaller mutual distance (for example, on front and back covers of the mobile device) may be used in the higher frequency subbands.

The second issue, causing problems with existing solutions, concerns the assumption of sound propagation in a lossless medium. In an example embodiment, the shadowing effect of a communication device (e.g., a mobile device) mechanics may be taken into account during the iterative optimization of the beamformer coefficients $h_j(k)$ since the optimization may be based on measurement data.

As described above, the third issue, causing problems with existing solutions, deals with the frequency band of operation of the beamformer. In an example embodiment, the beamformer parameters may be optimized separately for each frequency subband. The different parameter values for each subband may allow an example embodiment to generate directional audio fields throughout the needed frequency range.

Also, in an instance in which some of the microphone signals are blocked or deteriorated, for example, by user interference or wind noise, etc. an example embodiment may switch and utilize secondary microphones in the affected frequency subbands. Information of the microphones being blocked may be detected from an algorithm(s), for example, based on an example embodiment analyzing the microphone signal levels. In addition, the beam parameters for the set of microphones including the secondary microphones may be predetermined in order to produce the desired directional output.

In one example embodiment, a method for providing directional audio capture is provided. The method may include assigning at least one beam direction, among a plurality of beam directions, in which to direct directionality of an output signal of one or more microphones. The method may further include dividing microphone signals of each of the one or more microphones into selected frequency subbands wherein an analysis is performed. The method may further include selecting at least one set of microphones of a communication device for the selected frequency subbands. The method may further include optimizing the assigned beam direction by adjusting at least one beamformer parameter based on the selected set of microphones and at least one of the selected frequency subbands.

In another example embodiment, an apparatus for providing directional audio capture is provided. The apparatus may include a processor and a memory including computer program code. The memory and computer program code are configured to, with the processor, cause the apparatus to at least perform operations including assigning at least one beam direction, among a plurality of beam directions, in which to direct directionality of an output signal of one or more microphones. The at least one memory and the computer program code are further configured to, with the processor, cause the apparatus to divide microphone signals of each of the one or more microphones into selected frequency subbands wherein an analysis is performed. The at least one memory and the computer program code are further configured to, with the processor, cause the apparatus to select at least one set of microphones of a communication device for the selected frequency subbands. The at least one memory and the computer program code are further configured to, with the processor, cause the apparatus to optimize the assigned beam direction by adjusting at least one beamformer parameter based on the selected set of microphones and at least one of the selected frequency subbands.

In another example embodiment, a computer program product for providing directional audio capture is provided. The computer program product includes at least one computer-readable storage medium having computer-readable program code portions stored therein. The computer-executable program code instructions may include program code instructions configured to assign at least one beam direction, among a plurality of beam directions, in which to direct directionality of an output signal of one or more microphones. The program code instructions may also divide microphone signals of each of the one or more microphones into selected frequency subbands wherein an analysis is performed. The program code instructions may also select at least one set of microphones of a communication device for the selected frequency subbands. The program code instructions may also optimize the assigned beam direction by adjusting at least one beamformer parameter based on the selected set of microphones and at least one of the selected frequency subbands.

In another example embodiment, an apparatus for providing directional audio capture is provided. The apparatus may include a processor and a memory including computer program code. The memory and computer program code are configured to, with the processor, cause the apparatus to at least perform operations including enabling one or more microphones to detect at least one acoustic signal from one or more sound sources. The at least one memory and the computer program code are further configured to, with the processor, cause the apparatus to communicate with a beamformer wherein at least one beam direction is assigned based on a recording event. The at least one memory and the computer program code are further configured to, with the processor, cause the apparatus to analyze one or more microphone signals to select at least one set of microphones for the recording event, wherein the beamformer optimizes at least one parameter of the assigned beam direction based on the selected set of microphones.

BRIEF DESCRIPTION OF THE SEVERAL VIEWS OF THE DRAWINGS

Figure 1:
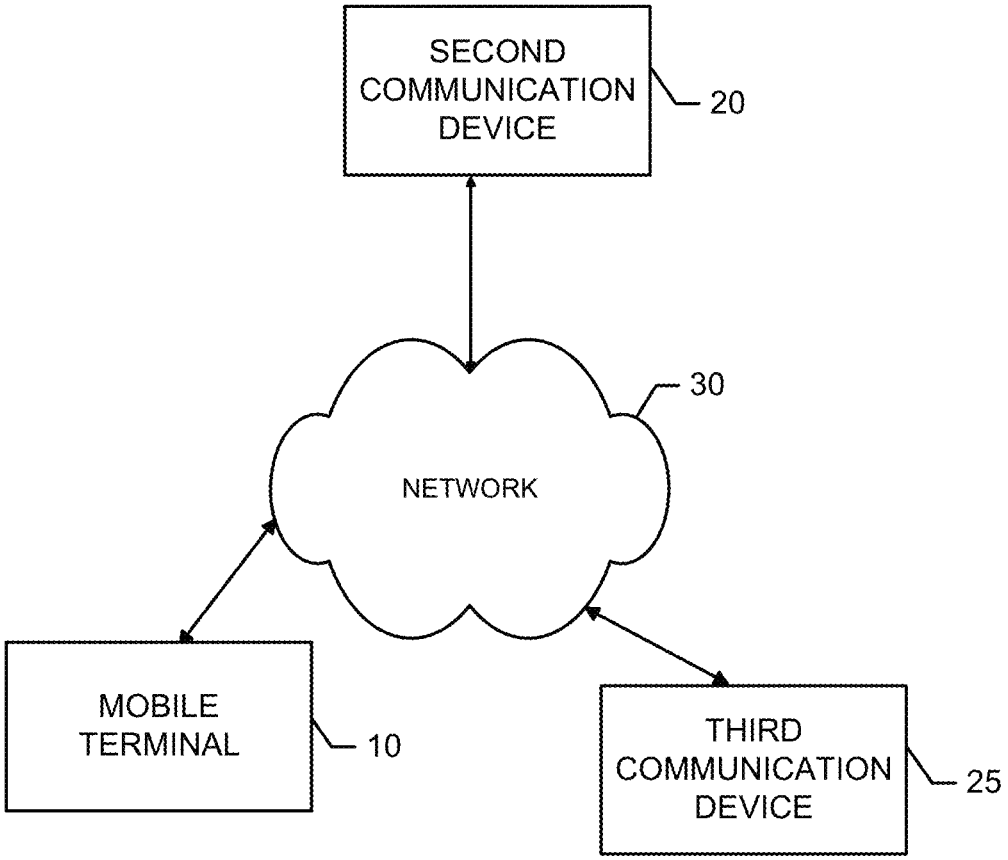
Figure 2:
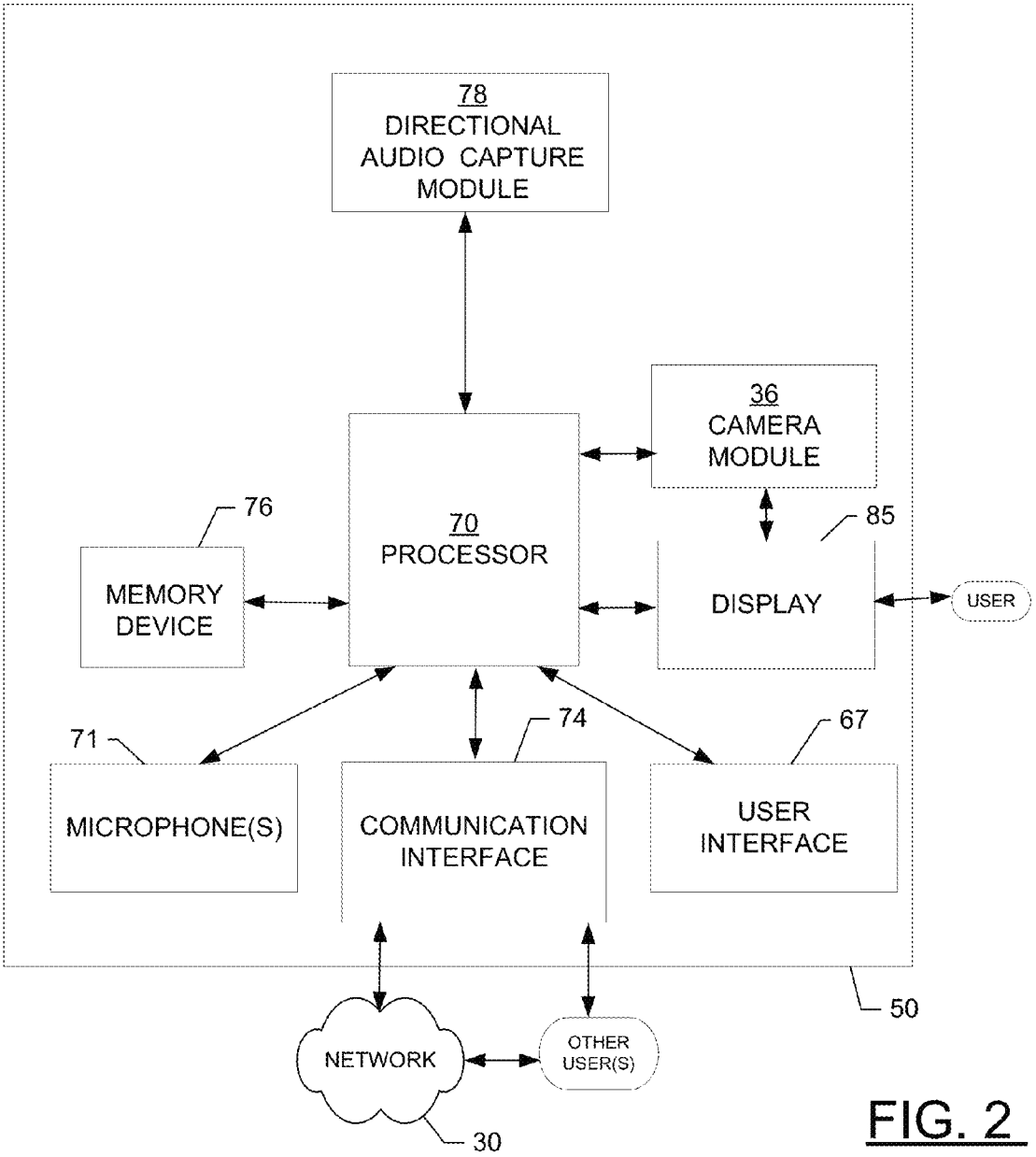
Figure 3:
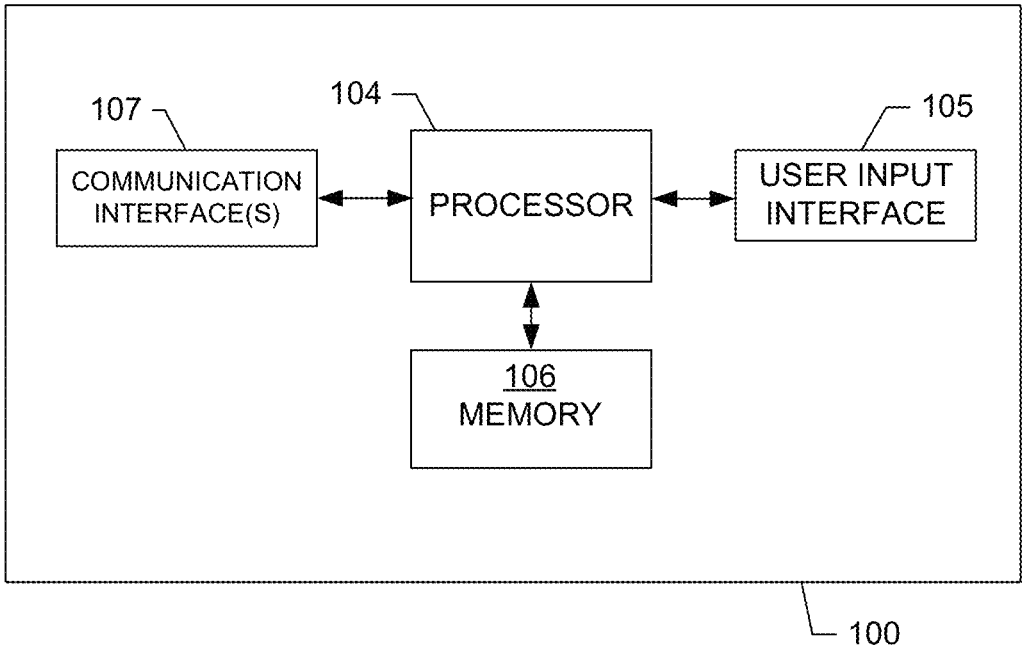
Figure 4:
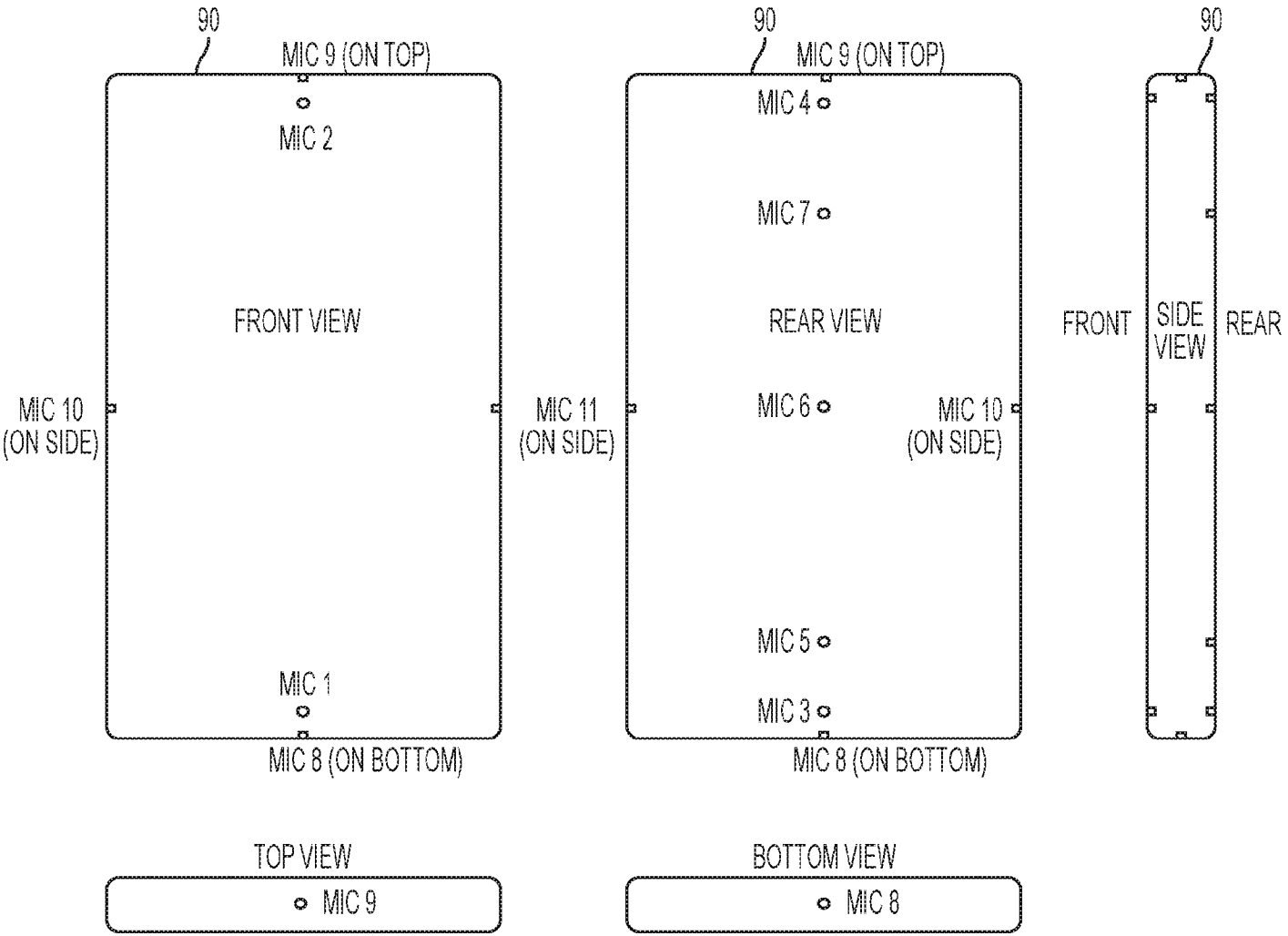
Figure 5:
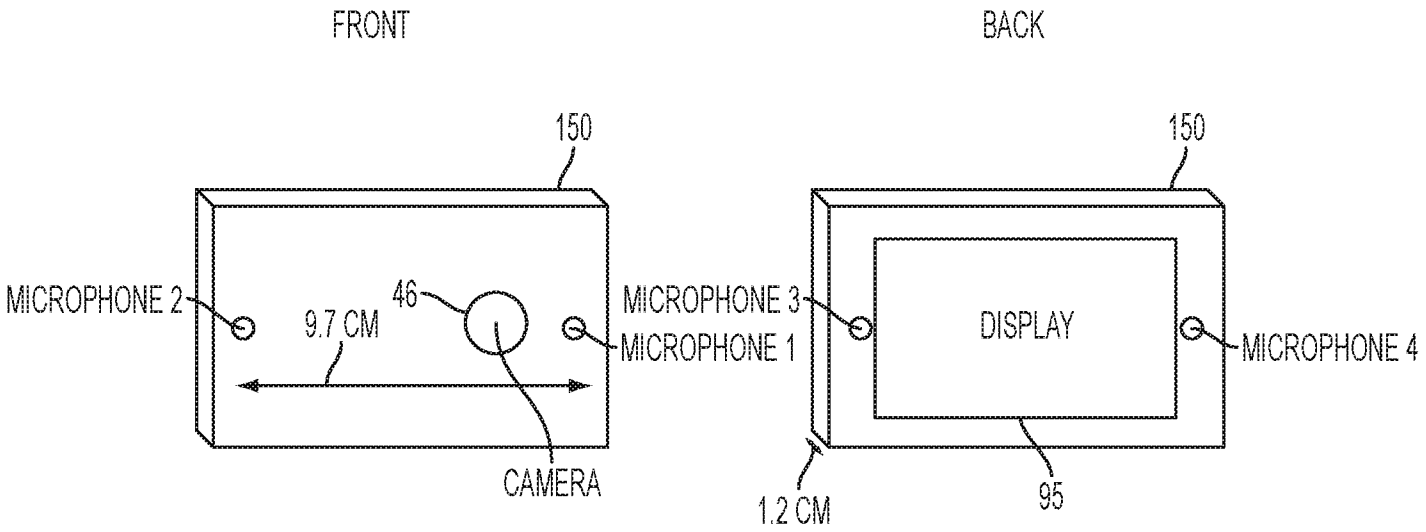
Figure 6:
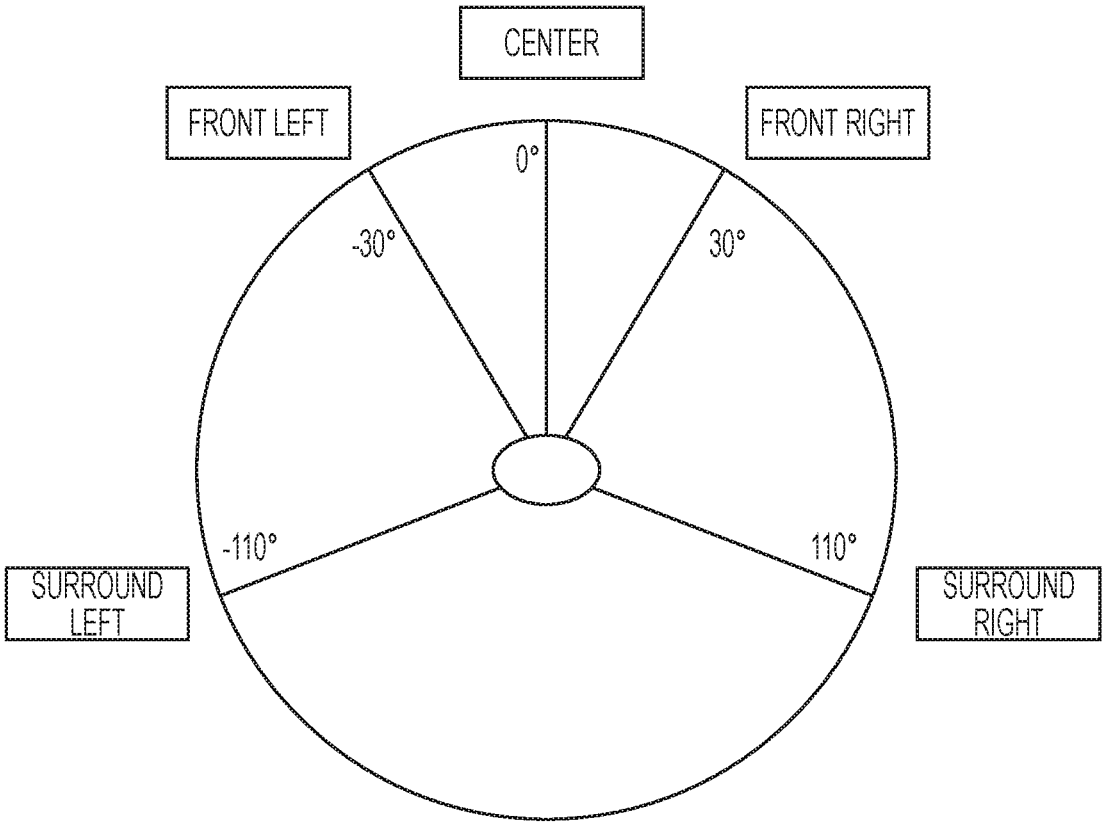
Figure 7:
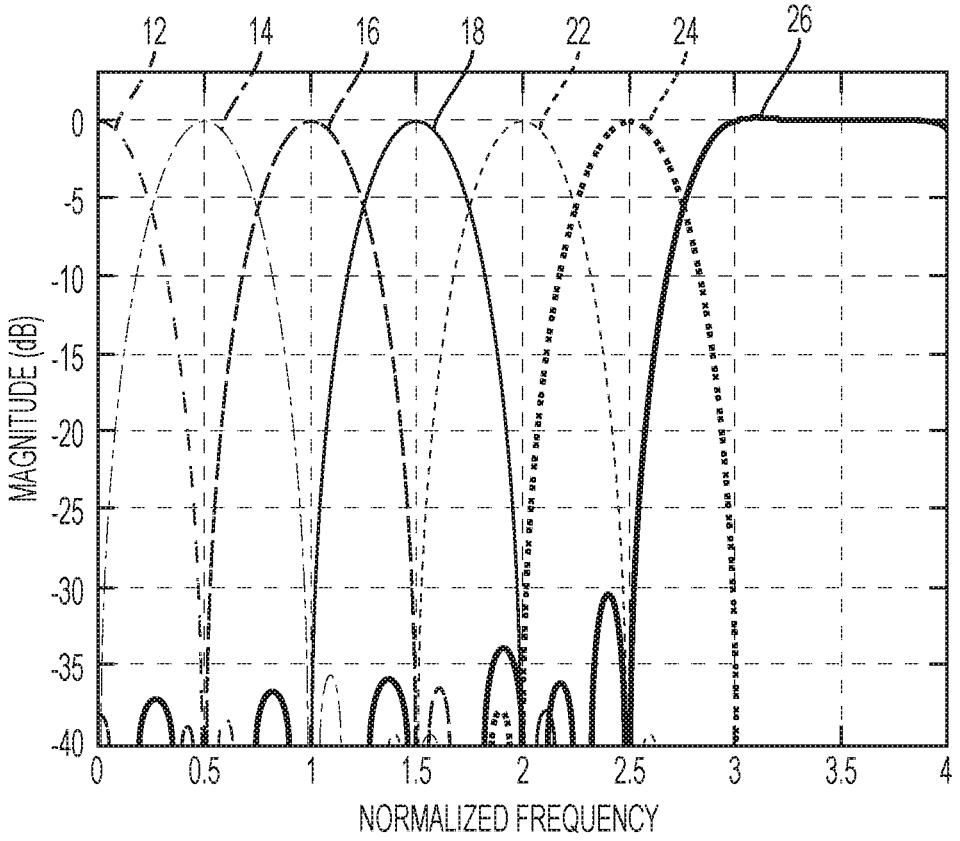
Figure 8:
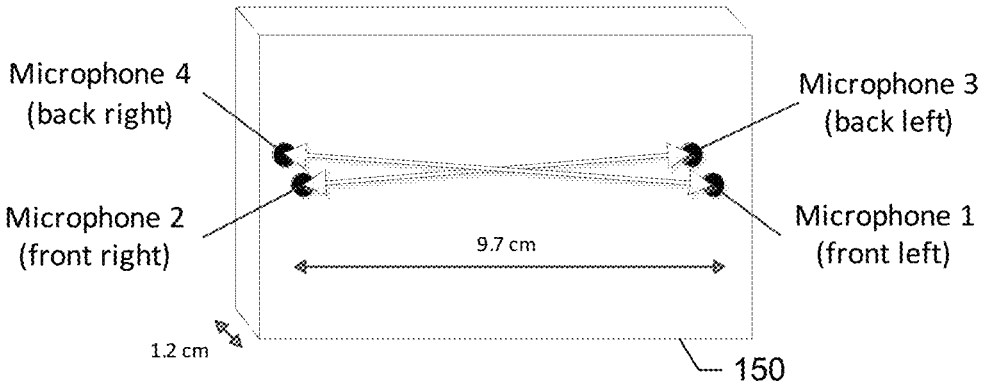
Figure 9:
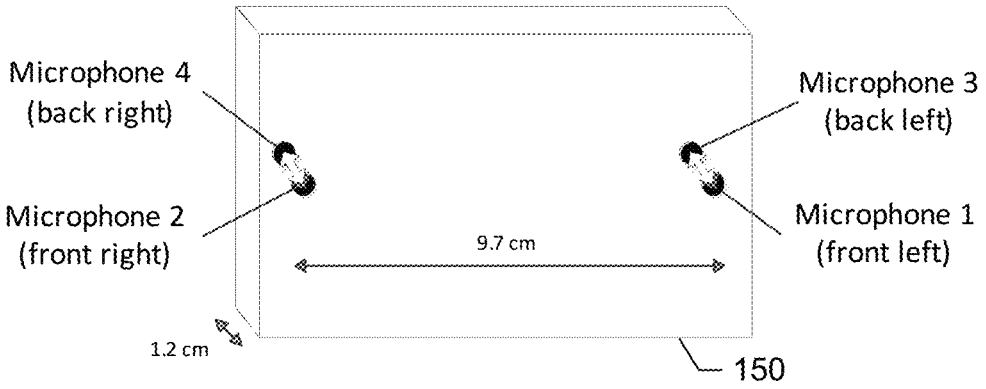
Figure 10:
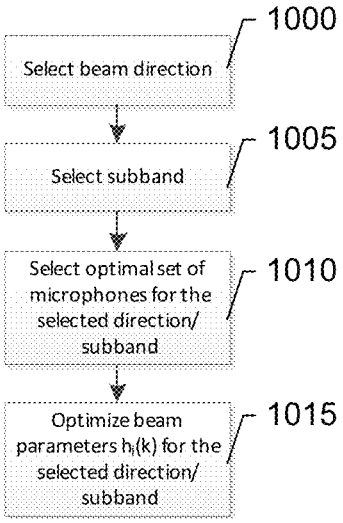
Figure 11:
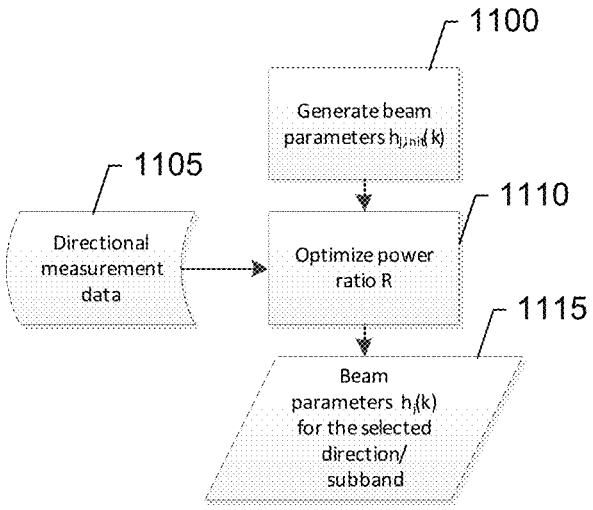
Figure 12:
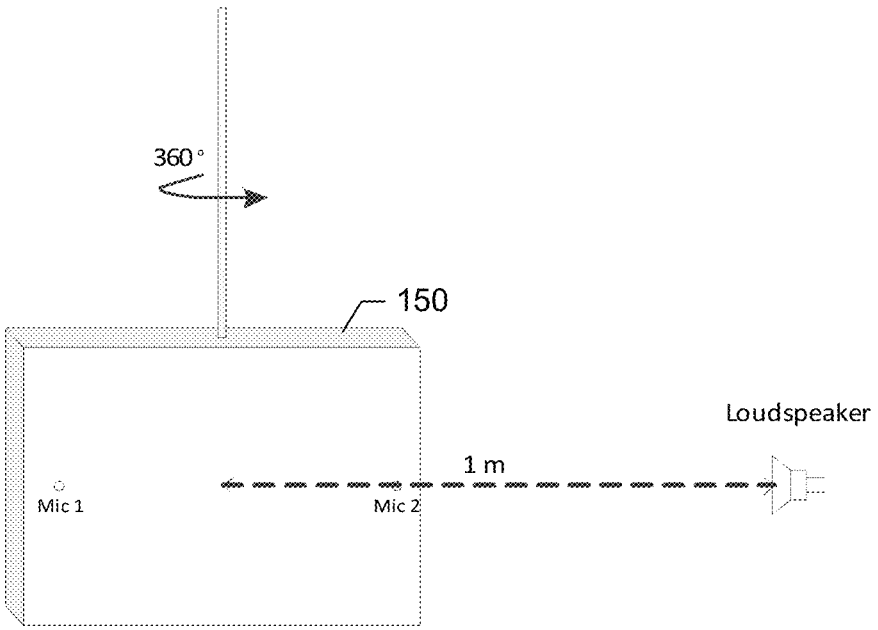
Figure 13:
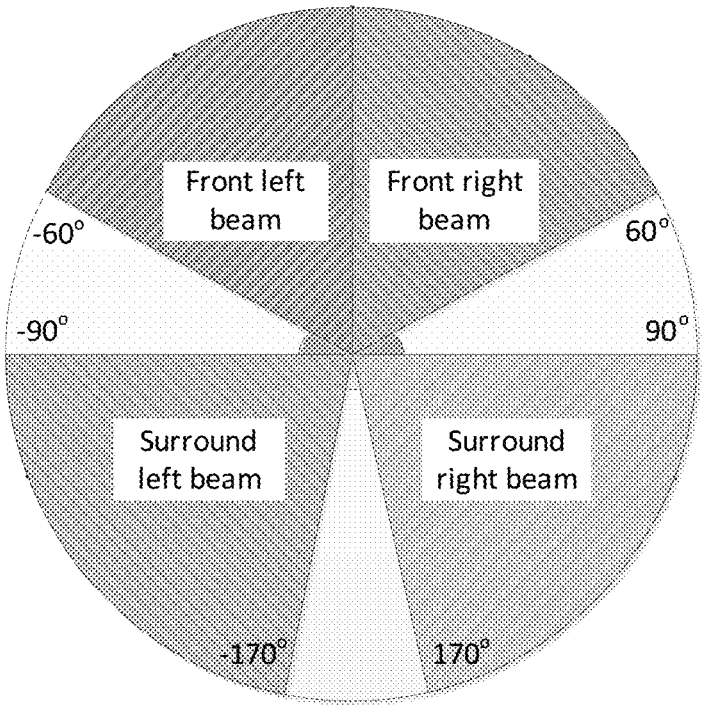
Figure 14:
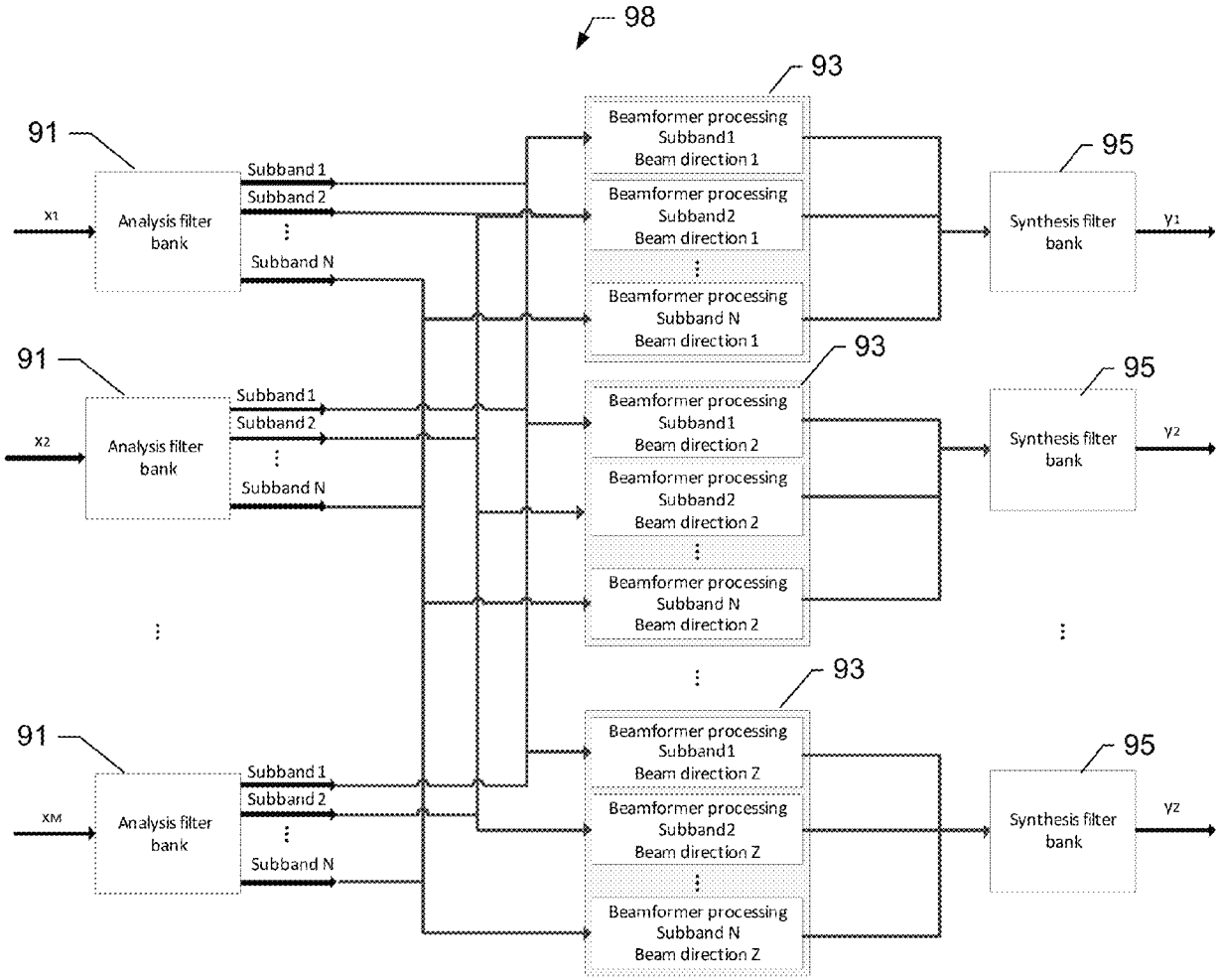
Figure 17:
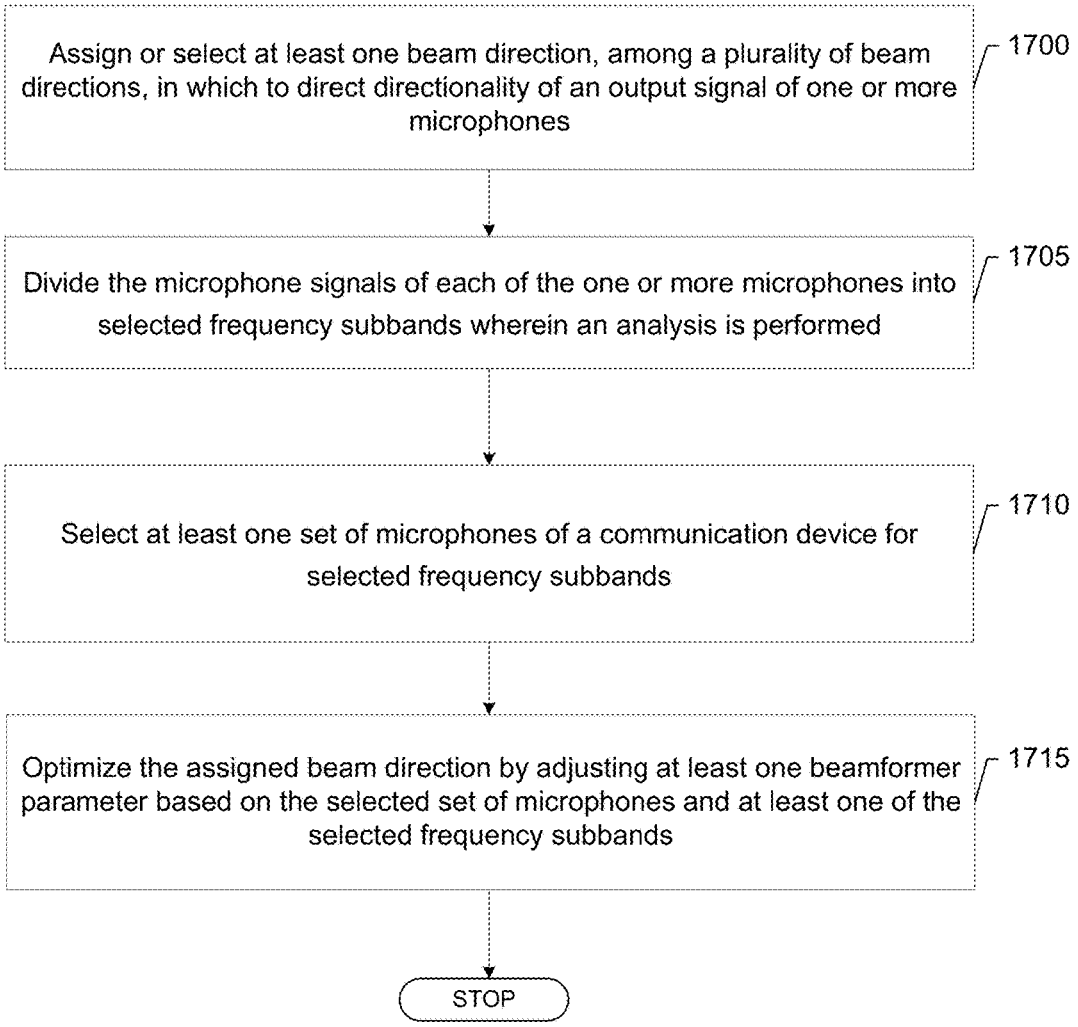
Figure 18:
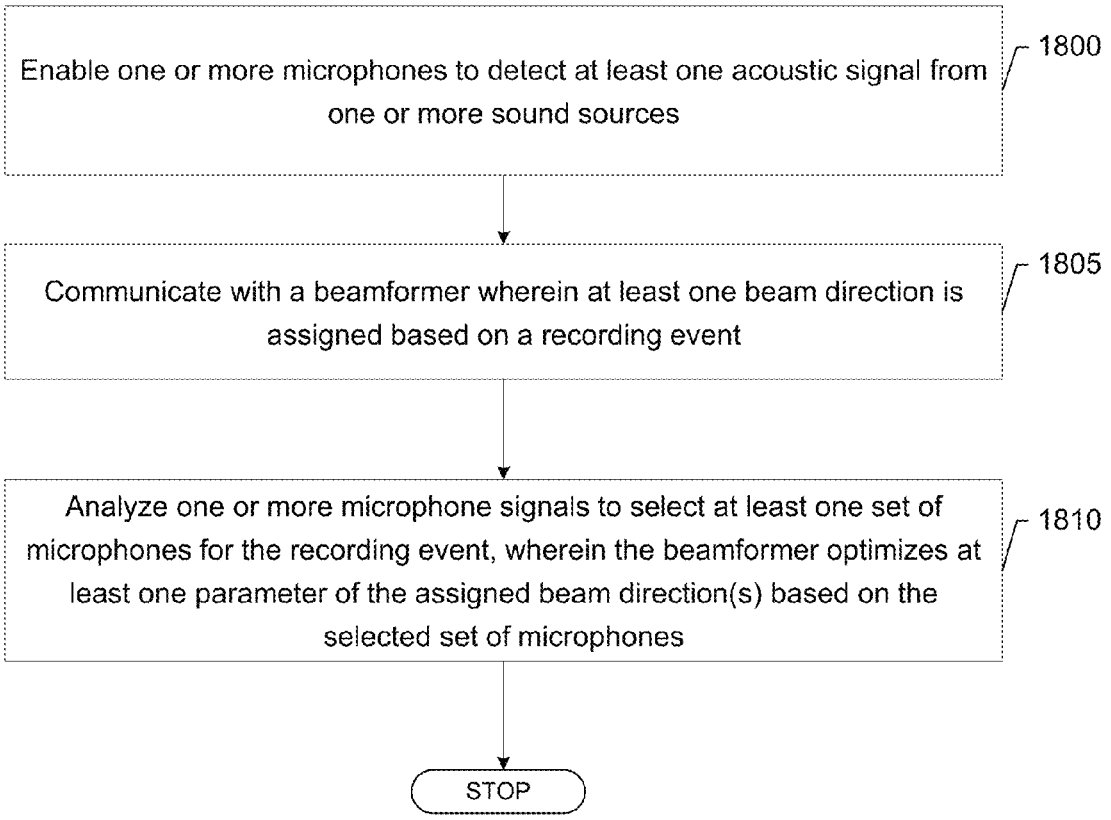

Having thus described some example embodiments of the invention in general terms, reference will now be made to the accompanying drawings, which are not necessarily drawn to scale, and wherein:

FIG. 1 is a schematic block diagram of a system according to an example embodiment;

FIG. 2 is a schematic block diagram of an apparatus according to an example embodiment;

FIG. 3 is a schematic block diagram of a network device according to an example embodiment;

FIG. 4 is a schematic block diagram of microphone positions in a communication device according to an example embodiment;

FIG. 5 is a schematic block diagram of microphone positions in a communication device according to another example embodiment;

FIG. 6 is a diagram illustrating speaker positions of surround sound according to an example embodiment;

FIG. 7 is a diagram illustrating frequency subbands utilized to optimize directionality of a beamformer output according to an example embodiment;

FIG. 8 is a diagram of a communication device including microphones used in low frequency subbands according to an example embodiment;

FIG. 9 is a diagram of a communication device including microphones used in high frequency subbands according to another example embodiment;

FIG. 10 is a flowchart for a beam optimization process according to an example embodiment;

FIG. 11 is a flowchart for optimizing beam parameters according to an example embodiment;

FIG. 12 is a diagram of a communication device in which directional measurements in an anechoic chamber are performed according to an example embodiment;

FIG. 13 is a diagram illustrating directions utilized in a beamformer parameter optimization according to an example embodiment;

FIG. 14 is a schematic block diagram of a device performing beamformer processing according to an example embodiment;

FIGS. 15A, 15B, 15C and 15D illustrate directivity plots for low frequency subbands according to an example embodiment;

FIGS. 16A, 16B, 16C and 16D illustrate directivity plots for high frequency subbands according to an example embodiment;

FIG. 17 illustrates a flowchart for performing a directional audio capture according to an example embodiment; and FIG. 18 illustrates a flowchart for performing a directional audio capture according to another example embodiment.

DETAILED DESCRIPTION

Some embodiments of the present invention will now be described more fully hereinafter with reference to the accompanying drawings, in which some, but not all embodiments of the invention are shown. Indeed, various embodiments of the invention may be embodied in many different forms and should not be construed as limited to the embodiments set forth herein. Like reference numerals refer to like elements throughout. As used herein, the terms "data," "content," "information" and similar terms may be used interchangeably to refer to data capable of being transmitted, received and/or stored in accordance with embodiments of the invention. Moreover, the term "exemplary", as used herein, is not provided to convey any qualitative assessment, but instead merely to convey an illustration of an example. Thus, use of any such terms should not be taken to limit the spirit and scope of embodiments of the invention.

Additionally, as used herein, the term 'circuitry' refers to (a) hardware-only circuit implementations (for example, implementations in analog circuitry and/or digital circuitry); (b) combinations of circuits and computer program product(s) comprising software and/or firmware instructions stored on one or more computer readable memories that work together to cause an apparatus to perform one or more functions described herein; and (c) circuits, such as, for example, a microprocessor(s) or a portion of a microprocessor(s), that require software or firmware for operation even if the software or firmware is not physically present. This definition of 'circuitry' applies to all uses of this term herein, including in any claims. As a further example, as used herein, the term 'circuitry' also includes an implementation comprising one or more processors and/or portion(s) thereof and accompanying software and/or firmware. As another example, the term 'circuitry' as used herein also includes, for example, a baseband integrated circuit or applications processor integrated circuit for a mobile phone or a similar integrated circuit in a server, a cellular network device, other network device, and/or other computing device.

As defined herein a "computer-readable storage medium," which refers to a non-transitory, physical or tangible storage medium (for example, volatile or non-volatile memory device), may be differentiated from a "computer-readable transmission medium," which refers to an electromagnetic signal.

Additionally, as referred to herein a "recording event" may include, but is not limited to, a capture of audio (e.g., an audio capture event) which may be associated with telephony (e.g., hands-free or hands-portable telephony), stereo recording, directional mono recording, surround sound recording (e.g., surround sound 5.1 recording, surround sound 7.1 recording, etc.) directional stereo recording, front end for audio processing, speech recognition and any other suitable cellular or non-cellular captures of audio. For example, a recording event may include a capture of audio associated with corresponding video data (e.g., a live video recording), etc.

FIG. 1 illustrates a generic system diagram in which a device such as a mobile terminal 10 is shown in an example communication environment. As shown in FIG. 1, an embodiment of a system in accordance with an example embodiment of the invention may include a first communication device (for example, mobile terminal 10) and a second communication device 20 capable of communication with each other via a network 30. In some cases, an embodiment of the invention may further include one or more additional communication devices, one of which is depicted in FIG. 1 as a third communication device 25. In one embodiment, not all systems that employ an embodiment of the invention may comprise all the devices illustrated and/or described herein. While an embodiment of the mobile terminal 10 and/or second and third communication devices 20 and 25 may be illustrated and hereinafter described for purposes of example, other types of terminals, such as portable digital assistants (PDAs), pagers, mobile televisions, mobile telephones, tablet computing devices, gaming devices, laptop computers, cameras, video recorders, audio/video players, radios, global positioning system (GPS) devices, Bluetooth headsets, Universal Serial Bus (USB) devices or any combination of the aforementioned, and other types of voice and text communications systems, can readily employ an embodiment of the present invention. Furthermore, devices that are not mobile, such as servers and personal computers may also readily employ an embodiment of the invention.

The network 30 may include a collection of various different nodes (of which the second and third communication devices 20 and 25 may be examples), devices or functions that may be in communication with each other via corresponding wired and/or wireless interfaces. As such, the illustration of FIG. 1 should be understood to be an example of a broad view of certain elements of the system and not an all-inclusive or detailed view of the system or the network 30. Although not necessary, in one embodiment, the network 30 may be capable of supporting communication in accordance with any one or more of a number of First-Generation (1G), Second-Generation (2G), 2.5G, Third-Generation (3G), 3.5G, 3.9G, Fourth-Generation (4G) mobile communication protocols, Long Term Evolution (LTE), LTE advanced (LTE-A) and/or the like. In one embodiment, the network 30 may be a point-to-point (P2P) network.

One or more communication terminals such as the mobile terminal 10 and the second and third communication devices 20 and 25 may be in communication with each other via the network 30 and each may include an antenna or antennas for transmitting signals to and for receiving signals from a base site, which could be, for example a base station that is a part of one or more cellular or mobile networks or an access point that may be coupled to a data network, such as a Local Area Network (LAN), a Metropolitan Area Network (MAN), and/or a Wide Area Network (WAN), such as the Internet. In turn, other devices such as processing elements (for example, personal computers, server computers or the like) may be coupled to the mobile terminal 10 and the second and third communication devices 20 and 25 via the network 30. By directly or indirectly connecting the mobile terminal 10 and the second and third communication devices 20 and 25 (and/or other devices) to the network 30, the mobile terminal 10 and the second and third communication devices 20 and 25 may be enabled to communicate with the other devices or each other, for example, according to numerous communication protocols including Hypertext Transfer Protocol (HTTP) and/or the like, to thereby carry out various communication or other functions of the mobile terminal 10 and the second and third communication devices 20 and 25, respectively.

Furthermore, the mobile terminal 10 and the second and third communication devices 20 and 25 may communicate in accordance with, for example, radio frequency (RF), near field communication (NFC), Bluetooth (BT), Infrared (IR) or any of a number of different wireline or wireless communication techniques, including Local Area Network (LAN), Wireless LAN (WLAN), Worldwide Interoperability for Microwave Access (WiMAX), Wireless Fidelity (WiFi), Ultra-Wide Band (UWB), Wibree techniques and/or the like. As such, the mobile terminal 10 and the second and third communication devices 20 and 25 may be enabled to communicate with the network 30 and each other by any of numerous different access mechanisms. For example, mobile access mechanisms such as LTE, Wideband Code Division Multiple Access (W-CDMA), CDMA2000, Global System for Mobile communications (GSM), General Packet Radio Service (GPRS) and/or the like may be supported as well as wireless access mechanisms such as WLAN, WiMAX, and/or the like and fixed access mechanisms such as Digital Subscriber Line (DSL), cable modems, Ethernet and/or the like.

In an example embodiment, the first communication device (for example, the mobile terminal 10) may be a mobile communication device such as, for example, a wireless telephone or other devices such as a personal digital assistant (PDA), mobile computing device, tablet computing device, camera, video recorder, audio/video player, positioning device, game device, television device, radio device, or various other like devices or combinations thereof. The second communication device 20 and the third communication device 25 may be mobile or fixed communication devices. However, in one example, the second communication device 20 and the third communication device 25 may be servers, remote computers or terminals such as, for example, personal computers (PCs) or laptop computers.

In an example embodiment, the network 30 may be an ad hoc or distributed network arranged to be a smart space. Thus, devices may enter and/or leave the network 30 and the devices of the network 30 may be capable of adjusting operations based on the entrance and/or exit of other devices to account for the addition or subtraction of respective devices or nodes and their corresponding capabilities.

In an example embodiment, the mobile terminal as well as the second and third communication devices 20 and 25 may employ an apparatus (for example, apparatus of FIG. 2) capable of employing an embodiment of the invention.

FIG. 2 illustrates a schematic block diagram of an apparatus for enabling directional audio capture according to an example embodiment of the invention. An example embodiment of the invention will now be described with reference to FIG. 2, in which certain elements of an apparatus 50 are displayed. The apparatus 50 of FIG. 2 may be employed, for example, on the mobile terminal 10 (and/or the second communication device 20 or the third communication device 25). Alternatively, the apparatus 50 may be embodied on a network device of the network 30. However, the apparatus 50 may alternatively be embodied at a variety of other devices, both mobile and fixed (such as, for example, any of the devices listed above). In some cases, an embodiment may be employed on a combination of devices. Accordingly, one embodiment of the invention may be embodied wholly at a single device (for example, the mobile terminal 10), by a plurality of devices in a distributed fashion (for example, on one or a plurality of devices in a P2P network) or by devices in a client/server relationship. Furthermore, it should be noted that the devices or elements described below may not be mandatory and thus some may be omitted in a certain embodiment.

Referring now to FIG. 2, the apparatus 50 may include or otherwise be in communication with a processor 70, a user interface 67, a communication interface 74, a memory device 76, a display 85, one or more microphones 71 (also referred to herein as microphone(s) 71), a camera module 36, and a directional audio capture module 78. The memory device 76 may include, for example, volatile and/or non-volatile memory. For example, the memory device 76 may be an electronic storage device (for example, a computer readable storage medium) comprising gates configured to store data (for example, bits) that may be retrievable by a machine (for example, a computing device like processor 70). In an example embodiment, the memory device 76 may be a tangible memory device that is not transitory. The memory device 76 may be configured to store information, data, files, applications, instructions or the like for enabling the apparatus to carry out various functions in accordance with an example embodiment of the invention. For example, the memory device 76 could be configured to buffer input data for processing by the processor 70. Additionally or alternatively, the memory device 76 could be configured to store instructions for execution by the processor 70. As yet another alternative, the memory device 76 may be one of a plurality of databases that store information and/or media content (for example, audio data, pictures, music, and videos).

The processor 70 may be embodied in a number of different ways. For example, the processor 70 may be embodied as one or more of various processing means such as a coprocessor, microprocessor, a controller, a digital signal processor (DSP), processing circuitry with or without an accompanying DSP, or various other processing devices including integrated circuits such as, for example, an ASIC (application specific integrated circuit), an FPGA (field programmable gate array), a microcontroller unit (MCU), a hardware accelerator, a special-purpose computer chip, or the like. In an example embodiment, the processor 70 may be configured to execute instructions stored in the memory device 76 or otherwise accessible to the processor 70. As such, whether configured by hardware or software methods, or by a combination thereof, the processor 70 may represent an entity (for example, physically embodied in circuitry) capable of performing operations according to an embodiment of the invention while configured accordingly. Thus, for example, when the processor 70 is embodied as an ASIC, FPGA or the like, the processor 70 may be specifically configured hardware for conducting the operations described herein. Alternatively, as another example, when the processor 70 is embodied as an executor of software instructions, the instructions may specifically configure the processor 70 to perform the algorithms and operations described herein when the instructions are executed. However, in some cases, the processor 70 may be a processor of a specific device (for example, a mobile terminal or network device) adapted for employing an embodiment of the invention by further configuration of the processor 70 by instructions for performing the algorithms and operations described herein. The processor 70 may include, among other things, a clock, an arithmetic logic unit (ALU) and logic gates configured to support operation of the processor 70.

In an example embodiment, the processor 70 may be configured to operate a connectivity program, such as a browser, Web browser or the like. In this regard, the connectivity program may enable the apparatus 50 to transmit and receive Web content, such as for example location-based content or any other suitable content, according to a Wireless Application Protocol (WAP), for example.

Meanwhile, the communication interface 74 may be any means such as a device or circuitry embodied in either hardware, a computer program product, or a combination of hardware and software that is configured to receive and/or transmit data from/to a network and/or any other device or module in communication with the apparatus 50. In this regard, the communication interface 74 may include, for example, an antenna (or multiple antennas) and supporting hardware and/or software for enabling communications with a wireless communication network (for example, network 30). In fixed environments, the communication interface 74 may alternatively or also support wired communication. As such, the communication interface 74 may include a communication modem and/or other hardware/software for supporting communication via cable, digital subscriber line (DSL), universal serial bus (USB), Ethernet or other mechanisms.

The microphones 71 may include a sensor that converts sound into an audio signal(s). The microphones 71 may be utilized for various applications including, but not limited to, stereo recording, directional mono recording, surround sound, front end for audio processing such as for telephony (e.g., hands-portable or hands free) or speech recognition and any other suitable applications.

The user interface 67 may be in communication with the processor 70 to receive an indication of a user input at the user interface 67 and/or to provide an audible, visual, mechanical or other output to the user. As such, the user interface 67 may include, for example, a keyboard, a mouse, a joystick, a display, a touch screen, a microphone, a speaker, or other input/output mechanisms. In an example embodiment in which the apparatus is embodied as a server or some other network devices, the user interface 67 may be limited, remotely located, or eliminated. The processor 70 may comprise user interface circuitry configured to control at least some functions of one or more elements of the user interface, such as, for example, a speaker, ringer, microphone, display, and/or the like. The processor 70 and/or user interface circuitry comprising the processor 70 may be configured to control one or more functions of one or more elements of the user interface through computer program instructions (for example, software and/or firmware) stored on a memory accessible to the processor 70 (for example, memory device 76, and/or the like).

The apparatus 50 includes a media capturing element, such as camera module 36. The camera module 36 may include a camera, video and/or audio module, in communication with the processor 70 and the display 85. The camera module 36 may be any means for capturing an image, video and/or audio for storage, display or transmission. For example, the camera module 36 may include a digital camera capable of forming a digital image file from a captured image. As such, the camera module 36 may include all hardware, such as a lens or other optical component(s), and software necessary for creating a digital image file from a captured image. Alternatively, the camera module 36 may include only the hardware needed to view an image, while a memory device (e.g., memory device 76) of the apparatus 50 stores instructions for execution by the processor 70 in the form of software necessary to create a digital image file from a captured image. In an example embodiment, the camera module 36 may further include a processing element such as a co-processor which assists the processor 70 in processing image data and an encoder and/or decoder for compressing and/or decompressing image data. The encoder and/or decoder may encode and/or decode according to a Joint Photographic Experts Group, (JPEG) standard format or another like format. In some cases, the camera module 36 may provide live image data to the display 85. In this regard, the camera module 36 may facilitate or provide a camera view to the display 85 to show or capture live image data, still image data, video data (e.g., a video recording and associated audio data), or any other suitable data. Moreover, in an example embodiment, the display 85 may be located on one side of the apparatus 50 and the camera module 36 may include a lens positioned on the opposite side of the apparatus 50 with respect to the display 85 to enable the camera module 36 to capture images on one side of the apparatus 50 and present a view of such images to the user positioned on the other side of the apparatus 50.

In an example embodiment, the processor 70 may be embodied as, include or otherwise control the directional audio capture module. The directional audio capture module 78 may be any means such as a device or circuitry operating in accordance with software or otherwise embodied in hardware or a combination of hardware and software (for example, processor 70 operating under software control, the processor 70 embodied as an ASIC or FPGA specifically configured to perform the operations described herein, or a combination thereof) thereby configuring the device or circuitry to perform the corresponding functions of the directional audio capture module 78 as described below. Thus, in an example in which software is employed, a device or circuitry (for example, the processor 70 in one example) executing the software forms the structure associated with such means.

In an example embodiment, the directional audio capture module 78 may capture a directional sound field(s). For example, the directional audio capture module 78 may utilize beamforming technology with array signal processing to capture one or more directional sound fields. By utilizing array signal processing the directional audio capture module 78 may capture a sound field(s) in a desired direction(s) while suppressing sound from other directions.

As examples, the directional audio capture module 78 may capture directional sound fields related to stereo, surround sound, directional mono recording associated with a video, telephony processing in a hand-portable or hands-free mode and any other suitable directional sound fields. For instance, the directional sound field captured by the directional audio capture module 78 may be used as a front end for sound processing such as speech recognition as one example or used in audio or videoconferencing applications, as another example.

Referring now to FIG. 3, a block diagram of an example embodiment of a network device is provided. As shown in FIG. 3, the network device (e.g., a server) generally includes a processor 104 and an associated memory 106. The memory 106 may comprise volatile and/or non-volatile memory, and may store content, data and/or the like. The memory 106 may store client applications, instructions, and/or the like for the processor 104 to perform the various operations of the network entity 100.

The processor 104 may also be connected to at least one communication interface 107 or other means for displaying, transmitting and/or receiving data, content, and/or the like. The user input interface 105 may comprise any of a number of devices allowing the network device 100 to receive data from a user, such as a keypad, a touch display, a joystick or other input device. In this regard, the processor 104 may comprise user interface circuitry configured to control at least some functions of one or more elements of the user input interface. The processor 104 and/or user interface circuitry of the processor 104 may be configured to control one or more functions of one or more elements of the user interface through computer program instructions (e.g., software and/or firmware) stored on a memory accessible to the processor 104 (e.g., volatile memory, non-volatile memory, and/or the like).

In one example embodiment, the processor 104 may optimize filter coefficients and may provide the optimized filter coefficients as parameters to the directional audio capture module 78 of apparatus 50. The processor 104 may optimize the filter coefficients based in part on performing a frequency subband division and microphone(s) selection, as described more fully below. The directional audio capture module 78 may utilize the received optimized filter coefficients as parameters to perform beamformer processing of corresponding microphone signals, as described more fully below. In some example embodiments, the processor 70 of the apparatus 50 may perform the optimization of the filter coefficients and may provide the optimized filter coefficients as parameters to the directional audio capture module 78 to perform the beamformer processing.

The directional audio capture module 78 may utilize a filter-and-sum beamforming technique for noise reduction in communication devices. In the filter-and-sum beamforming technique the recorded data may be processed by the directional audio capture module 78 by implementing Equation (1) below $$y(n) = \sum_{j=1}^{M} \sum_{k=0}^{L-1} h_j(k) x_j(n-k), \tag{1}$$

where M is the number of microphones (e.g., microphones 71) and L is the filter length. The filter coefficients are denoted by $h_j(k)$ and the microphone signal is denoted by $x_j$. In the filter-and-sum beamforming, the filter coefficients $h_j(k)$ are optimized regarding the microphone positions. In an example embodiment, a processor (e.g., processor 70, processor 104) may optimize the filter coefficients for the filter-and-sum beamforming technique given the microphone (e.g., microphone(s) 71) positions. In an example embodiment, the optimization of the filter coefficients may be performed by a processor (e.g., processor 70, processor 104) and the filter coefficients may then be provided as parameters to the directional audio capture module 78 which may perform beamformer processing of corresponding microphone signals. Additionally, the directional audio capture module 78 may utilize multiple independent beam designs for different frequency subbands, as described more fully below. In an example embodiment, the directional audio capture module 78 may also utilize predefined beams and/or predefined beamformer parameters. The beams may be designed based in part on using measurement data.

Referring now to FIG. 4, examples of microphone positioning in a communication device is provided according to an example embodiment. In the example embodiment of FIG. 3, one or more microphones (e.g., microphones 71) may be included in a communication device 90 (e.g., apparatus 50) at various positions. The directional audio capture module (e.g., directional audio capture module 78) may capture a directional sound field(s) in an instance in which there are at least two microphones in a communication device. In the example of FIG. 4, there may be two microphones that are placed near the top and bottom of the communication device 90 (e.g., apparatus 50). Some examples of such microphone pairs are 8 and 9, 1 and 4, or 1 and 7. These microphones may have such a mutual distance that the conventional beamforming approach is not useful.

The directional audio capture module (e.g., directional audio capture module 78) of the communication device 90 may utilize a designed beamformer for low frequencies which may enhance the directional capture and utilize the natural directionality of the microphones in the higher frequency subbands. One example application in which some of the microphone pairs may be utilized is enhanced stereo capture. Some of the microphone pairs may also be utilized for applications enhancing the audio quality of a hands-free call or in a hand-portable mode or any other suitable audio applications.

In the example embodiment of FIG. 4, two microphones may be located in a relatively close distance to each other such as, for example, the microphones 1 and 3, 1 and 5, 2 and 4, or 2 and 9. In this regard, the directional audio capture module may be utilized to design a good quality beam as the beam parameters may be designed separately for each frequency subband and using a directional measurement to assist the beam design. As an example, these microphone pairs (e.g., microphones pairs 1 and 3, 1 and 5, 2 and 4, or 2 and 9) may be utilized by the directional audio capture module for directional mono recording related to a video, or as a front end to audio processing in telephony or in speech recognition, or in any other suitable applications.

In an instance in which there are three microphones available (such as, for example, microphones 1, 3, and 4, or 1, 3, and, 7, or 1, 3, and 9) the directional audio capture module may be utilized to design a beamformer that utilizes the microphone pair 1 and 4 in low frequency subbands and microphone pair 1 and 3 in higher frequency subbands to generate a directional capture utilized in the hands-free or hands-portable telephony applications or as a front end for other audio processing applications. In this manner, the directional audio capture module may block low frequency disturbance in a null direction of the beam.

In one example embodiment, by utilizing 4 microphones (such as, for example, microphones 1, 2, 3, and 4) the directional capture module of the communication device 90 may generate a directional capture utilized in the hands-free or hand-portable telephony applications, as a front end for other audio processing applications, as an enhanced surround sound capture or as a directional stereo capture, as described more fully below by utilizing four microphones (such as, for example, microphones 1, 2, 3, and 4).

In another example embodiment, in an instance in which the directional audio capture module utilizes more than 4 microphones in the communication device 90, the directional audio capture may enable choosing of an optimal set of microphones regarding an application. By utilizing the directional audio capture module an independent set of microphones for each frequency subband may be chosen. For low frequency subbands a set of microphones with large mutual distance may be chosen. For the higher frequency subbands a set of microphones that are close to each other may be chosen. For each subband the distance between the microphones may be less than half of the shortest wavelength of that subband. Some examples of the applications supported by at least a subset of the microphones of the communication device of FIG. 3 are provided below:

Microphones 8 and 9—stereo recording,

Microphones 1 and 3 or 2 and 4—directional mono recording,

Microphones 1-4—surround sound 5.1 recording or directional stereo recording, Microphones 1-4, 8-9—surround sound 7.1 recording, Microphones 1-11—surround sound recording including the height channels (microphones 5-7 may be utilized in one example embodiment), and Microphone 1 and any of the microphones 3-7—front end for audio processing such as, for example, for telephony (e.g., hand-portable or hands-free) or speech recognition.

The directional audio capture module may utilize microphones of the apparatus for any other suitable applications (e.g., audio applications).

In an instance in which some of the microphone signals of a subset of the microphones of the communication device 90 of FIG. 4 are blocked or deteriorated, for example, by user interference or wind noise, the directional audio capture module may switch to use secondary microphones in the affected frequency subbands. The directional audio capture module may detect an indication of the microphones being blocked, for example, based on analyzing microphone signal levels. Additionally, the beam parameters for the set of microphones including the secondary microphones may be predetermined by the directional audio capture module in order to produce the desired directional output.

For purposes of illustration and not of limitation, consider an instance in which a user of the communication device 90 (e.g., apparatus 50) is recording video and the user accidentally blocks microphone 10 which is providing the output of the audio for the video. In this regard, the directional audio capture module 78 may switch to microphone 11 instead of microphone 10 in an instance in which the directional audio capture module 78 determines that the signal (e.g., the audio signal) output from microphone 10 is weak or deteriorated denoting that the microphone 10 may be partially or completely blocked. In this example embodiment, the directional audio capture module 78 may switch to microphone 10 in response to determining that the microphone signal level output from microphone 10 is unacceptable.

Referring now to FIG. 5, a communication device utilizing microphones to generate surround sound is provided according to an example embodiment. In the example embodiment of FIG. 4, the communication device 150 (e.g., apparatus 50) may utilize four microphones (e.g., microphones 1, 2, 3 and 4 (e.g., microphones 71)) to generate surround sound via a surround sound 5.1 recording application. The placement of the microphones 1, 2, 3 and 4 are shown in FIG. 4. As shown in FIG. 5, the microphones are placed near the ends of the communication device 150 on both sides (e.g., front and back). In this example embodiment, the front side may denote the side with the camera 46 (e.g., camera module 36) and the back side may denote the side with the display 95 (e.g., display 85). As an example, the microphones 1, 2, 3, and 4 may be used to generate 5.1 surround sound which may be associated with a video recording executed by the communication device 150.

In 5.1 surround sound there are five different directions for audio capture: (1) front left (−30°), (2) front right (30°), (3) front (0°), (4) surround left (−110°), and (5) surround right (110°), as shown in FIG. 6. The front direction (0°) denotes the direction of the camera 46. Beams are directed, via the directional audio capture module, towards the 5.1 surround sound speaker positions front left, front right, surround left, and surround right. The sound for the center speaker may be generated from the front left and front right beams.

Referring now to FIG. 7, a diagram illustrating frequency subbands utilized for optimizing directionality of a beamformer output is provided according to an example embodiment. In order to utilize the microphones 1, 2, 3 and 4 of communication device 150, the beamformer parameters may be optimized independently for seven different frequency subbands (e.g., frequency subbands 12, 14, 16, 18, 22, 24, 26) shown in FIG. 7. In the example embodiment of FIG. 7, the seven frequency subbands were selected for the surround sound 5.1 recording application. However, in an alternative example embodiment other frequency subbands (for example, more or less than seven different frequency subbands) may be selected. In one example embodiment, a processor (e.g., processor 70, processor 104) may select the frequency subbands. In an example embodiment, the frequency subbands and set of microphones related to each subband may be preselected (for example, by a processor (e.g., processor 70, processor 104) or receipt of an indication of a selection via user input (e.g., via user interface 67, user input interface 105)) and may be provided as parameters to the directional audio capture module 78 which may use the parameters for beamformer processing, as described more fully below.

For each subband, the set of microphones that provides the best directional output may be chosen by a processor (e.g. processor 70, processor 104). In the lower frequency subbands (e.g., below 1.5 kHz) microphones located in different ends of the communication device 150 may be used as shown in FIG. 8. For example, a processor (e.g., processor 70, processor 104) may select and use microphones 1 and 4 to generate front left and surround right beams, and may select and use microphones 2 and 3 to generate front right and surround left beams. In the higher frequency subbands (e.g., 1.5 kHz and above) the microphones in the opposite sides of the same end of the communication device 150 may be utilized, as shown in FIG. 9. For example, microphones 1 and 3 may be utilized by the directional audio capture module to generate front left and surround left beams, whereas microphones 2 and 4 may be used to generate front right and surround right beams. The microphones (e.g., microphone pairs 1 and 4 and microphone pairs 2 and 3 of FIG. 8) with larger mutual distance may offer better directionality regarding the 5.1 surround sound than the microphones (e.g., microphone pairs 2 and 4 and microphone pairs 1 and 3 of FIG. 9) with smaller mutual distance. However, the microphones located in the different ends of the communication device 150 may not be used for all frequency subbands because of the aliasing effect.

In an example embodiment, the directional audio capture module 78 may perform the beamformer processing in each of the seven frequency subbands of FIG. 7 and may use a different set of microphones for the beamformer processing in each of the seven frequency subbands of FIG. 7.

For purposes of illustration and not of limitation, the three lowest frequency subbands (e.g., frequency subbands 12, 14, 16) of the seven frequency subbands may be used for microphone pair 1 and 4 and microphone pair 2 and 3. On the other hand, the four highest frequency subbands (e.g., frequency subbands 18, 22, 24, 26) of the seven frequency subbands may be used for microphone pair 1 and 3 and microphone pair 2 and 4.

In response to performing the beamforming processing in each of the frequency subbands for the different pairs or sets of microphones the directional audio capture module 78 may combine the microphone output signals to produce directional output signals as described more fully below.

Referring now to FIG. 10, a flowchart of an example method of a beam optimization process is provided according to an example embodiment. In the example embodiment of FIG. 10, each direction (e.g., front left, front right, surround left, surround right) and each subband (e.g., frequency subbands 12, 14, 16, 18, 22, 24, 26) is processed independently for example by a processor (e.g., processor 70). In this example embodiment, the number of subbands is seven and the number of optimized directions is four (e.g., front left, front right, surround left, surround right). As such, the optimization routine may be repeated 7×4=28 times, for example, by a processor (e.g., processor 70). At operation 1000, a processor (e.g., processor 70, processor 104) may receive an indication of selection (e.g., via user input) of the beam direction (e.g., the front left direction). For example, the beam directions may correspond to fixed directions (for example, 5.1 surround sound may include five fixed directions) used in a recording. Different application uses (e.g., 5.1 surround sound recording, a stereo recording, etc.) may have different beam directions that are predefined. A user may choose among the different application uses. For example, the user may select or desire to make a 5.1 surround sound recording, a stereo recording or a directional mono recording, etc. In this regard, the user may choose (e.g., via a user input (e.g., via user interface 67, via user input interface 105)) a beam direction (e.g., front left) among the preset/fixed directions for a desired application usage (e.g., 5.1 surround sound). At operation 1005, a processor (e.g., processor 70, processor 104) may select one or more frequency subbands (e.g., frequency subbands 12, 14, 16, 18, 22, 24 and/or 26). At operation 1010, a processor (e.g., processor 70, processor 104) may select an optimal set of microphones for each direction/subband. In an example embodiment, the frequency subbands and the set of microphones may be selected (for example, by a processor) during a beam optimization process. At operation 1015, a processor (e.g., processor 70, processor 104) may optimize the beamformer filter coefficients $h_j(k)$, in part, by executing Equation (1), for each direction/subband for the selected optimal set of microphones.

Referring now to FIG. 11, a flowchart of an example method of beamformer filter optimization is provided according to an example embodiment. At operation 1100, a processor (e.g., processor 70, processor 104) may generate a first set of the beamformer filter coefficients $h_j(k)$ (also referred to herein as $h_{j,init}(k)$ by executing Equation (1) for each subband and direction using the free field assumption. The free field assumption denotes that shadowing of the acoustic field by the body of a communication device (e.g., a mobile device) is not taken into account. The beamformer filter coefficients $h_j(k)$ are then further optimized, for example, by a processor (e.g., processor 70, processor 104), for each subband and each beam direction using an iterative optimization routine, as described below.

At operation 1105, directional measurement data may be utilized (for example, by a processor (e.g., processor 70, processor 104)) in part, to optimize the beamformer parameters. For instance, the directional measurement may be performed in an anechoic chamber, in which the communication device is rotated 360 degrees in 10 degree steps. At each step (e.g., each 10 degree step), white noise is played from a loudspeaker at 1 m distance from the communication device, as shown in FIG. 12. The microphone signals acquired from this directional measurement are then used to assist in the beam design (for example, during operation 1105). The directional measurement data may be processed by a processor (e.g., processor 70, processor 104) of the communication device based in part on using the filter coefficients $h_j(k)$ for the subband being analyzed. At operation 1110, as a measure of the beam quality, a processor (e.g., processor 70, processor 104) may calculate a power ratio (R) from the processed directional measurement data in which R=(power in the desired direction)/(power in all other directions). At operation 1115, a processor (e.g., processor 70, processor 104) may iteratively alter the filter coefficients or beam parameters $h_j(k)$ to maximize the power ratio for the direction (e.g., the front left direction) and subband (e.g., frequency subband 12) being processed to produce the optimized beam parameters. In an alternative example embodiment, the beamformer filter coefficients may be optimized without using measurement data but instead using acoustics modeling.

Referring now to FIG. 13, a diagram illustrating the desired directions for the 5.1 surround sound beams is provided according to an example embodiment. For example, for the front left beam, the desired direction is from −60° to 0°, and for the front right beam the desired direction is from 0° to 60°. Additionally, for the surround left beam, the desired direction is from −90° to −170°, and for the surround right beam the desired direction is from 90° to 170°.

The filter coefficients or beam parameters $h_j(k)$ may then be iteratively altered for example by a processor (e.g., processor 70, processor 104) to maximize the power ratio for the direction and subband being processed. For example, in an instance in which the desired or selected beam direction is front left, a processor (e.g., processor 70, processor 104) may calculate the power in this direction from 0° to −60° versus the power in all other directions (e.g., the front right beam, the surround right beam, the surround left beam) to determine the power ratio (R=power in the desired direction/power in all other directions) for the front left beam. In an instance in which the power ratio is selected for the desired direction, a processor (e.g., processor 70, processor 104) may optimize the beam parameters so that the beam is directed in the desired direction which is the front left direction in this example. In an instance in which another beam direction is selected such as, for example, the front right direction, a processor (e.g., processor 70) may calculate the power in the desired direction of 0° to 60° versus power in all other directions (e.g., the front left direction, the surround left direction, the surround right direction).

In this example, the beam parameters $h_j(k)$ may be optimized in order to maximize the power ratio R. However, in an alternative example embodiment any other optimization criterion may be utilized taking into account the particular application where the directional sound capture is needed. For example, in some instances a good attenuation of sound may be desired from a certain direction.

Referring now to FIG. 14, a schematic block diagram of a device for performing beamformer processing is provided according to an example embodiment. The directional audio capture module 98 (e.g., directional audio capture module 78) of the example embodiment of FIG. 14 may utilize the optimized beam parameters to process the microphone signals of a set of microphones to produce the directional outputs. For example, in FIG. 14, the microphone signals are denoted by $x_1, x_2, \ldots x_M$ and the directional output signals by $y_1, y_2, \ldots y_Z$. In the 5.1 surround sound example, the number of microphones M may be four (M=4) (e.g., microphones 1, 2, 3 and 4 of FIG. 5) and the number of beam directions Z may be four (e.g., Z=4) (e.g., the front left beam direction, the front right beam direction, the surround right beam direction and the surround left beam direction). The directional audio capture module 98 may use an optimal set of microphones for a certain beam direction and subband. The optimal set of microphones may be different for each beam direction and subband.

In the example embodiment of FIG. 14, the analysis filter bank 91 may split the microphone signals into N subbands. For example, in an instance in which N is seven, and $x_1$ corresponds to the microphone signal of microphone 1 of FIG. 5, the analysis filter bank 91 may split the microphone signal $x_1$ into each of the seven subbands. The output signals (e.g., subband signals) of the analysis filter bank 91 for each subband may be provided to the beamformer processing modules 93. The beamformer processing modules 93 may perform beamformer processing in each subband for each beam direction for selected microphones. In this manner, the beamformer processing modules 93 may perform beamforming processing independently for each of the subbands and also for each beam direction. Each of the beamformer processing modules 93 may utilize different beam parameters to obtain optimal directional signals in the corresponding beam directions.

The directional signals generated by the beamformer processing modules 93 may be provided to the synthesis filter banks 95. Each of the synthesis filter banks 95 may combine the directional signals for each of the subbands for the corresponding directions to produce directional output signals $y_1, y_2, \ldots y_Z$. For purposes of illustration and not of limitation, in the example in which there are four beam directions for 5.1 surround sound, $y_1$ may correspond to the directional output signal for front left, $y_2$ may correspond to the directional output signal for front right, $y_3$ may correspond to the directional output signal for surround left and $y_4$ may correspond to the directional output signal for surround right.

Referring now to FIGS. 15A, 15B, 15C and 15D, diagrams of directivity plots according to an example embodiment are provided. For example, FIGS. 15A, 15B, 15C and 15D illustrate the directivity plots of the beams for the 5.1 surround sound directions for lower frequency subbands (e.g., frequency subbands below 1.5 kHz (e.g., 500 Hz, 750 Hz, 1000 Hz)), in which microphones (e.g., microphone pairs 1 and 4 and 2 and 3) are located at different ends of a communication device (e.g., communication device 150).

Figure 15A:
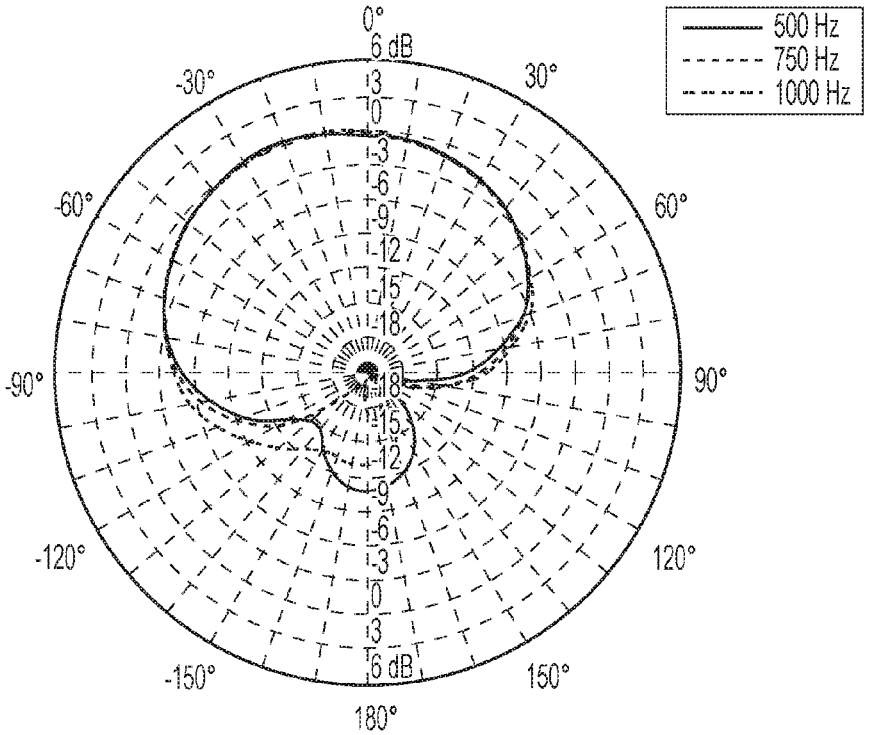
Figure 15B:
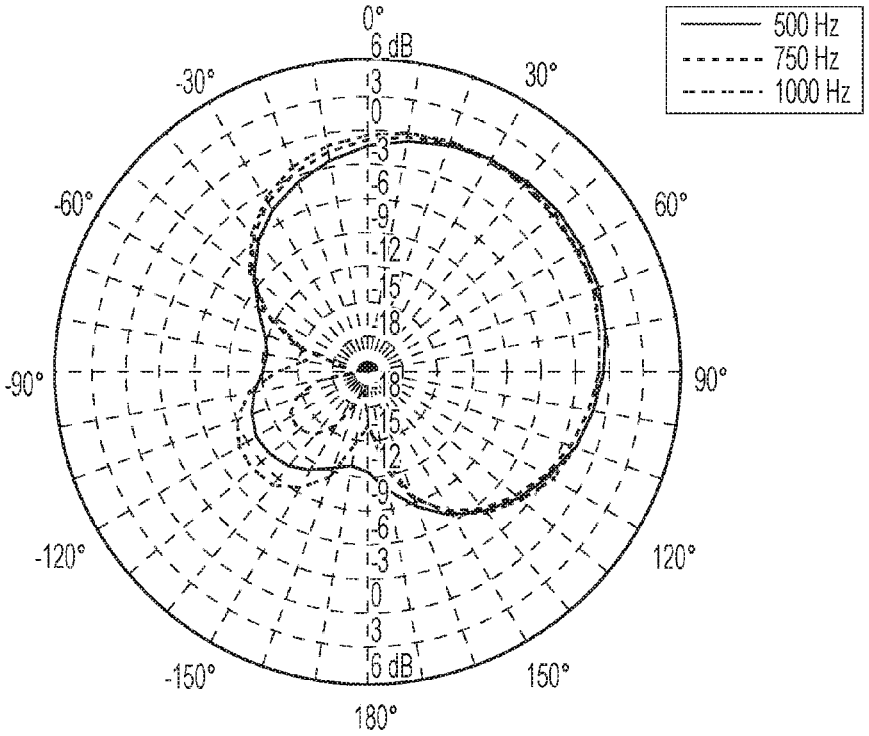
Figure 15C:
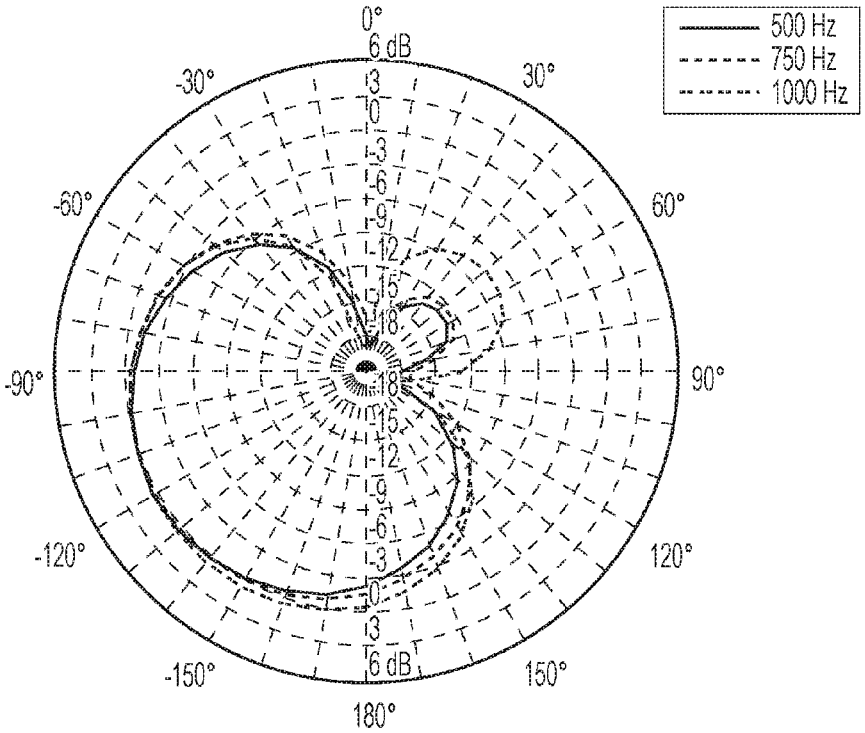
Figure 15D:
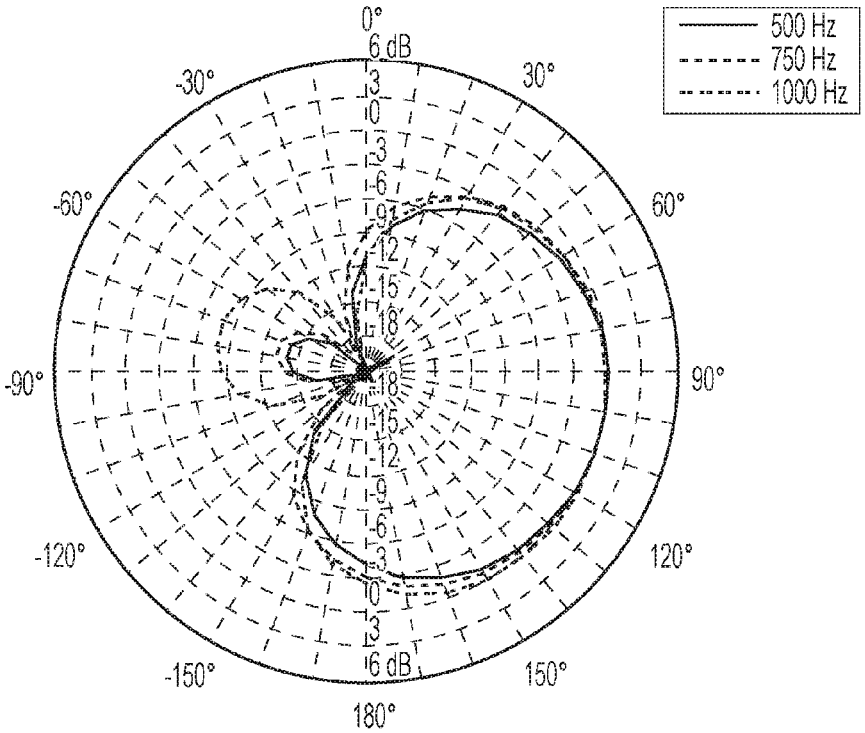

In the example embodiments of FIGS. 15A, 15B, 15C, and 15D, beamformer parameters may be optimized to achieve the 5.1 surround sound capture. In this regard, FIG. 15A illustrates a beam in the front left direction (−30°) and FIG. 15B illustrates a beam in the front right direction (30°). Additionally, FIG. 15C illustrates a beam in the surround left direction (−110°) and FIG. 15D illustrates a beam in the surround right direction (110°). In an example embodiment, the beams of the directivity plots corresponding to FIGS. 15A, 15B, 15C and 15D may correspond to the directional output signals (e.g., $y_1, y_2, \ldots y_Z$) output from the synthesis filter bank 95 of the directional audio capture module 98 (e.g., directional audio capture module 78).

Referring now to FIGS. 16A, 16B, 16C and 16D, diagrams of directivity plots according to another example embodiment are provided. For example, FIGS. 16A, 16B, 16C and 16D illustrate the directivity plots of the beams for the 5.1 surround sound directions for higher frequency subbands (e.g., frequency subbands equal to 1.5 kHz and above (e.g., 1500 Hz, 2000 Hz, 2500 Hz, 3000 Hz)). In the higher frequency subbands, the microphones (e.g., microphone pairs 1 and 3 and 2 and 4) in the opposite sides of a communication device (e.g., communication device 150) may be utilized.

Figure 16A:
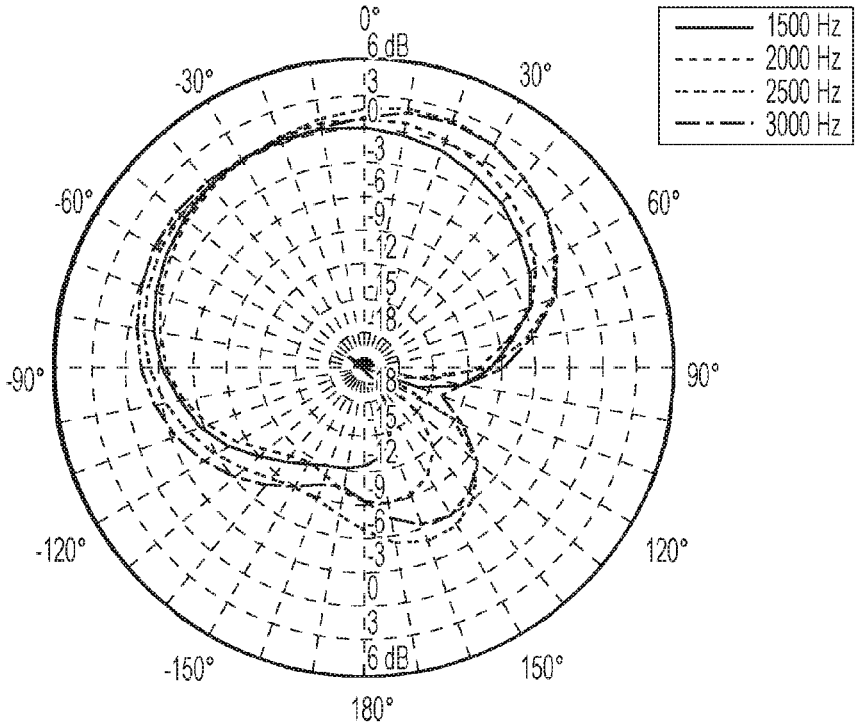
Figure 16B:
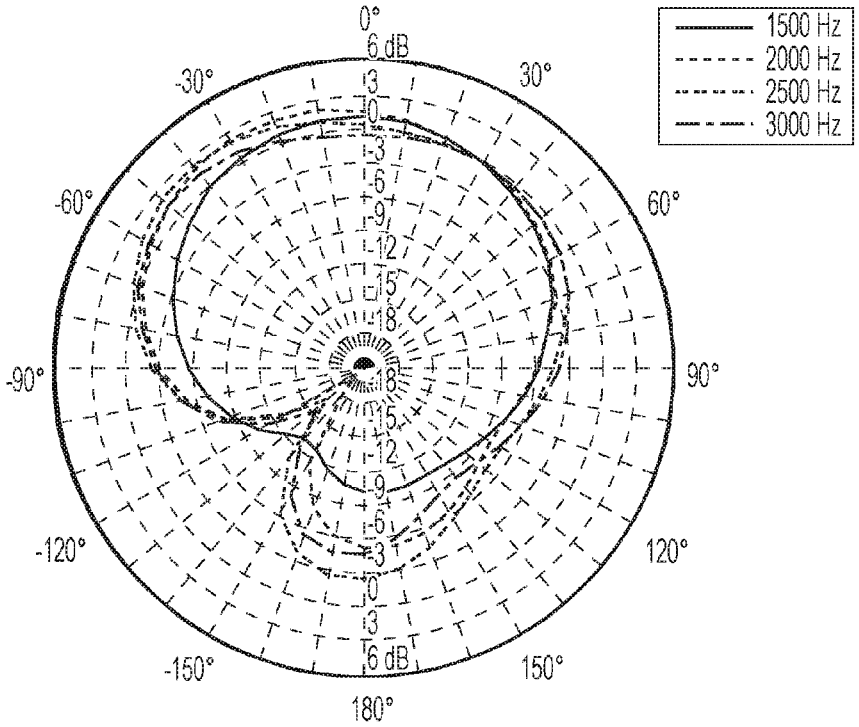
Figure 16C:
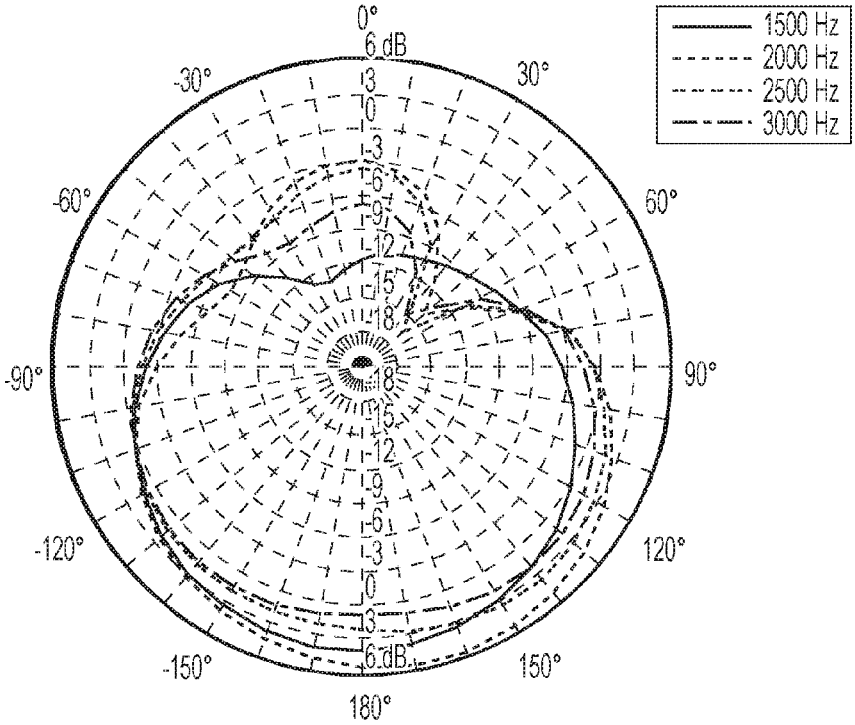
Figure 16D:
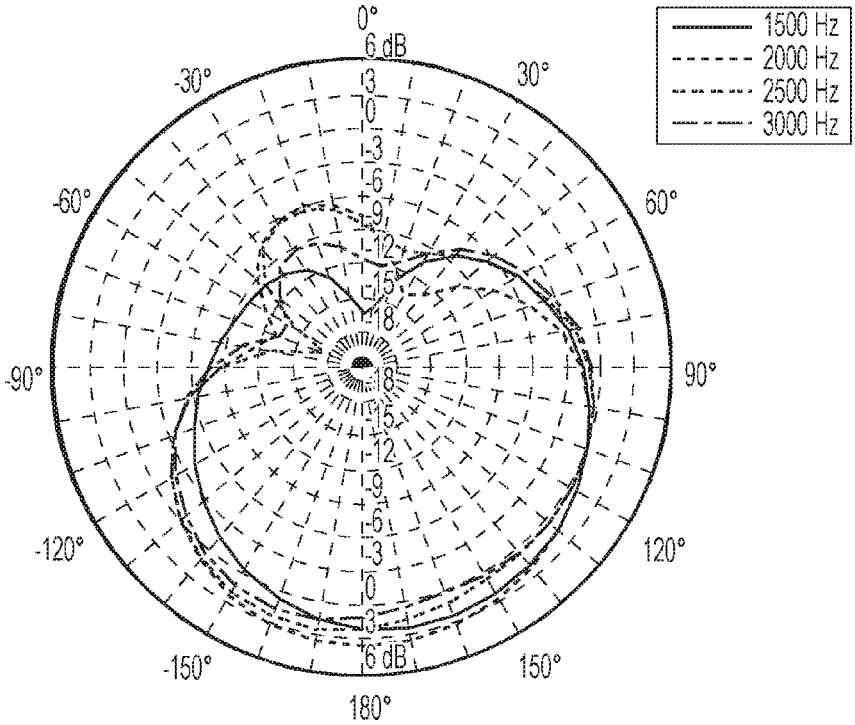

In the example embodiments of FIGS. 16A, 16B, 16C, and 16D, beamformer parameters may be optimized to achieve the 5.1 surround sound capture. In this regard, FIG. 16A illustrates a beam in the front left direction (−30°) and FIG. 16B illustrates a beam in the front right direction (30°). Additionally, FIG. 15C illustrates a beam in the surround left direction (−110°) and FIG. 16D illustrates a beam in the surround right direction (110°).

Referring now to FIG. 17, an example embodiment of a flowchart for enabling directional audio capture is provided. At operation 1700, a communication device (for example, communication device 150 (for example, apparatus 50)) may include means, such as the processor 70 and/or the like, for assigning or selecting at least one beam direction (e.g., the front left beam direction), among a plurality of beam directions (e.g., the front right beam direction, the surround left beam direction, the surround right beam direction), in which to direct directionality of an output signal (e.g., a directional output signal) of one or more microphones. At operation 1705, the communication device may include means, such as the processor 70 and/or the like, for dividing microphone signals of each of the one or more microphones into selected frequency subbands (e.g., frequency subbands 12, 14, 16, 18, 22, 24, 26) wherein an analysis is performed. In one example embodiment, the analysis performed may be a subband analysis utilized to select a pair or set of microphones.

At operation 1710, the communication device (e.g., communication device 150) may include means, such as the processor 70 and/or the like, for selecting at least one set of microphones (e.g., microphone pair 1 and 4 and microphone pair 2 and 3, etc.) of a communication device for selected frequency subbands. At operation 1715, the communication device may include means, such as the directional audio capture module 78, the processor 70 and/or the like, for optimizing the assigned beam direction by adjusting at least one beamformer parameter based on the selected set of microphones and at least one of the selected frequency subbands. In some alternative example embodiments, the assigning of the beam direction, the dividing of the microphone signals into selected frequency subbands and the selection of the set of microphones for selected frequency subbands may be performed by a processor such as, for example, processor 104 of network device 100 to optimize filter coefficients. The processor 104 of the network device 100 may provide the optimized filter coefficients as parameters to the directional audio capture module 78 to enable the directional audio capture module 78 to optimize the assigned beam direction by adjusting at least one beamformer parameter based on the selected set of microphones and at least one of the selected frequency subbands.

Referring now to FIG. 18, a flowchart for enabling directional audio capture according to another example embodiment is provided. At operation 1800, a communication device (for example, communication device 150 (for example, apparatus 50)) may include means, such as the processor 70 and/or the like, for enabling one or more microphones to detect at least one acoustic signal from one or more sound sources (e.g., voices of users or other individuals, etc.). At operation 1805, the communication device may include means, such as the directional audio capture module 78, the processor 70 and/or the like, for communicating with a beamformer wherein at least one beam direction (e.g., the front left beam direction) is assigned based on a recording event (e.g., a video recording with accompanying audio data). At operation 1810, the communication device may include means, such as the directional audio capture module 78, the processor 70 and/or the like, for analyzing one or more microphone signals to select at least one set of microphones (e.g., microphone pair 1 and 4) for the recording event. The beamformer may optimize at least one parameter (e.g., a beamformer parameter) of the assigned beam direction(s) based on the selected set of microphones.

It should be pointed out that FIGS. 10, 11, 17 and 18 are flowcharts of a system, method and computer program product according to an example embodiment of the invention. It will be understood that each block of the flowcharts, and combinations of blocks in the flowcharts, can be implemented by various means, such as hardware, firmware, and/or a computer program product including one or more computer program instructions. For example, one or more of the procedures described above may be embodied by computer program instructions. In this regard, in an example embodiment, the computer program instructions which embody the procedures described above are stored by a memory device (for example, memory device 76, memory 106) and executed by a processor (for example, processor 70, processor 104, directional audio capture module 78). As will be appreciated, any such computer program instructions may be loaded onto a computer or other programmable apparatus (for example, hardware) to produce a machine, such that the instructions which execute on the computer or other programmable apparatus cause the functions specified in the flowcharts blocks to be implemented. In one embodiment, the computer program instructions are stored in a computer-readable memory that can direct a computer or other programmable apparatus to function in a particular manner, such that the instructions stored in the computer-readable memory produce an article of manufacture including instructions which implement the function(s) specified in the flowcharts blocks. The computer program instructions may also be loaded onto a computer or other programmable apparatus to cause a series of operations to be performed on the computer or other programmable apparatus to produce a computer-implemented process such that the instructions which execute on the computer or other programmable apparatus implement the functions specified in the flowcharts blocks.

Accordingly, blocks of the flowcharts support combinations of means for performing the specified functions. It will also be understood that one or more blocks of the flowcharts, and combinations of blocks in the flowcharts, can be implemented by special purpose hardware-based computer systems which perform the specified functions, or combinations of special purpose hardware and computer instructions.

In an example embodiment, an apparatus for performing the methods of FIGS. 10, 11, 17 and 18 above may comprise a processor (for example, the processor 70, processor 104, directional audio capture module 78) configured to perform some or each of the operations (1000-1015, 1100-1115, 1700-1715, 1800-1810) described above. The processor may, for example, be configured to perform the operations (1000-1015, 1100-1115, 1700-1715, 1800-1810) by performing hardware implemented logical functions, executing stored instructions, or executing algorithms for performing each of the operations. Alternatively, the apparatus may comprise means for performing each of the operations described above. In this regard, according to an example embodiment, examples of means for performing operations (1000-1015, 1100-1115, 1700-1715, 1800-1810) may comprise, for example, the processor 70 (for example, as means for performing any of the operations described above), the processor 104, the directional audio capture module 78 and/or a device or circuit for executing instructions or executing an algorithm for processing information as described above.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. An apparatus comprising:

a directional audio capture module; and a plurality of microphones positioned at predetermined locations of the apparatus;

the directional audio capture module is configured to:

assign at least one beam direction, among a plurality of beam directions, in which to direct directionality of an output signal of one or more of the microphones;

select a first set of microphones comprising at least two microphones, of the plurality of microphones, for a first frequency band;

select a second set of microphones comprising at least two microphones, of the plurality of microphones, for a second frequency band; and optimize the output signal for the assigned at least one beam direction by adjusting at least one beamformer parameter based on the selected first and second sets of microphones, wherein respective sets of microphone signals for the first and second frequency bands are processed by the adjusted at least one beamformer parameter to optimize the output signal for the assigned at least one beam direction.

2. The apparatus of claim 1, wherein the directional audio capture module is further configured to:

select the first set of microphones and the second set of microphones based in part on a distance between the microphones of the first set and the microphones of the second set.

3. The apparatus of claim 1, wherein:

at least a subset of the plurality of microphones support one or more of a plurality of applications comprising stereo recording, directional mono recording, surround sound recording, directional stereo recording, telephony processing or speech recognition processing.

4. The apparatus of claim 1, wherein the directional audio capture module is further configured to:

select an alternative set of microphones, of the plurality of microphones, to replace at least one of the first set of microphones or the second set of microphones in an instance in which interference is detected affecting the first frequency band or the second frequency band.

5. The apparatus of claim 1, wherein the directional audio capture module is further configured to:

detect that at least one of the first frequency band or the second frequency band comprises a low frequency band in response to detecting that a respective frequency is below a frequency threshold.

6. The apparatus of claim 1, wherein the directional audio capture module is further configured to:

detect that at least one of the first frequency band or the second frequency band comprises a high frequency band in response to detecting that a respective frequency is greater than or equal to a frequency threshold.

7. The apparatus of claim 1, wherein:

at least one of the first set of microphones or the second set of microphones are utilized for a plurality of frequency bands.

8. The apparatus of claim 1, further comprising at least one processor wherein:

the at least one processor or the directional audio capture module is further configured to:

optimize each beam direction, of the plurality of beam directions, and each frequency band, among a plurality of frequency bands, independently.

9. The apparatus of claim 1, wherein:

the at least one beamformer parameter comprises one or more beamformer filter coefficients.

10. The apparatus of claim 1, wherein the directional audio capture module is further configured to:

select the first set of microphones by selecting the first set of microphones comprising a large mutual distance, that exceeds a threshold distance, between the microphones of the first set for the first frequency band, comprising a low frequency band that is below a frequency threshold.

11. The apparatus of claim 10, wherein the directional audio capture module is further configured to:

select the second set of microphones by selecting the second set of microphones comprising a small mutual distance, that is below the threshold distance, between the microphones of the second set for the second frequency band, comprising a high frequency band that is greater than or equal to the frequency threshold.

12. The apparatus of claim 11, wherein:

the threshold distance comprises a distance of ten centimeters.

13. The apparatus of claim 11, wherein:

the microphones of the first set, comprising the large mutual distance between the microphones of the first set, provide a higher level of directionality for audio recordings than the microphones of the second set, comprising the small mutual distance between the microphones of the second set.

14. The apparatus of claim 11, wherein the directional audio capture module is further configured to:

utilize the microphones of the first set in the low frequency band and the microphones of the second set in the high frequency band to support a hands-free telephony application or another audio processing application.

15. The apparatus of claim 14, wherein the directional audio capture module is further configured to:

block low frequency disturbance in a null direction of the output signal for the assigned at least one beam direction.

16. A method comprising:

assigning, via a directional audio capture module of an apparatus, at least one beam direction, among a plurality of beam directions, in which to direct directionality of an output signal of one or more microphones of a plurality of microphones positioned at predetermined locations of the apparatus;

selecting, via the directional audio capture module, a first set of microphones comprising at least two microphones, of the plurality of microphones, for a first frequency band;

selecting, via the directional audio capture module, a second set of microphones comprising at least two microphones, of the plurality of microphones, for a second frequency band; and optimizing, via the directional audio capture module, the assigned at least one beam direction by adjusting at least one beamformer parameter based on the selected first and second sets of microphones, wherein respective sets of microphone signals for the first and second frequency bands are processed by the adjusted at least one beamformer parameter to optimize the output signal for the assigned at least one beam direction.

17. The method of claim 16, further comprising:

selecting, via the directional audio capture module, the first set of microphones and the second set of microphones based in part on a distance between the microphones of the first set and the microphones of the second set.

18. The method of claim 16, further comprising:

supporting, via at least a subset of the plurality of microphones, one or more of a plurality of applications comprising stereo recording, directional mono recording, surround sound recording, directional stereo recording, telephony processing or speech recognition processing.

19. The method of claim 16, further comprising:

selecting, via the directional audio capture module, an alternative set of microphones, of the plurality of microphones, to replace at least one of the first set of microphones or the second set of microphones in an instance in which interference is detected affecting the first frequency band or the second frequency band.

20. The method of claim 16, further comprising:

detecting, via the directional audio capture module, that at least one of the first frequency band or the second frequency band comprises a low frequency band in response to detecting that a respective frequency is below a frequency threshold.

21. The method of claim 16, further comprising:

detecting, via the directional audio capture module, that at least one of the first frequency band or the second frequency band comprises a high frequency band in response to detecting that a respective frequency is greater than or equal to a frequency threshold.

22. The method of claim 16, wherein:

at least one of the first set of microphones or the second set of microphones are utilized for a plurality of frequency bands.

23. The method of claim 16, further comprising:

optimizing, via a processor of the apparatus or the directional audio capture module, each beam direction, of the plurality of beam directions, and each frequency band, among a plurality of frequency bands, independently.

24. The method of claim 16, wherein:

the at least one beamformer parameter comprises one or more beamformer filter coefficients.

25. The method of claim 16, wherein:

selecting the first set of microphones further comprises selecting the first set of microphones comprising a large mutual distance, that exceeds a threshold distance, between the microphones of the first set for the first frequency band, comprising a low frequency band that is below a frequency threshold.

26. The method of claim 25, wherein:

selecting the second set of microphones further comprises selecting the second set of microphones comprising a small mutual distance, that is below the threshold distance, between the microphones of the second set for the second frequency band, comprising a high frequency band that is greater than or equal to the frequency threshold.

27. The method of claim 26, wherein:

the threshold distance comprises a distance of ten centimeters.

28. The method of claim 26, wherein:

the microphones of the first set, comprising the large mutual distance between the microphones of the first set, provide a higher level of directionality for audio recordings than the microphones of the second set, comprising the small mutual distance between the microphones of the second set.

29. The method of claim 26, further comprising:

utilizing the microphones of the first set in the low frequency band and the microphones of the second set in the high frequency band to support a hands-free telephony application or another audio processing application.

30. The method of claim 29, further comprising:

blocking low frequency disturbance in a null direction of the output signal for the assigned at least one beam direction.

31. A computer program product comprising at least one non-transitory computer-readable storage medium having computer-executable program code instructions stored therein, the computer-executable program code instructions comprising:

program code instructions configured to assign at least one beam direction, among a plurality of beam directions, in which to direct directionality of an output signal of one or more microphones of a plurality of microphones positioned at predetermined locations of an apparatus;

program code instructions configured to select a first set of microphones comprising at least two microphones, of the plurality of microphones, for a first frequency band;

program code instructions configured to select a second set of microphones comprising at least two microphones, of the plurality of microphones, for a second frequency band; and program code instructions configured to optimize the output signal for the assigned at least one beam direction by adjusting at least one beamformer parameter based on the selected first and second sets of microphones, wherein respective sets of microphone signals for the first and second frequency bands are processed by the adjusted at least one beamformer parameter to optimize the output signal for the assigned at least one beam direction.

32. The computer program product of claim 31, further comprising:

program code instructions configured to select the first set of microphones and the second set of microphones based in part on a distance between the microphones of the first set and the microphones of the second set.

33. The computer program product of claim 31, further comprising:

program code instructions configured to support, via at least a subset of the plurality of microphones, one or more of a plurality of applications comprising stereo recording, directional mono recording, surround sound recording, directional stereo recording, telephony processing or speech recognition processing.

34. The computer program product of claim 31, further comprising:

program code instructions configured to select an alternative set of microphones, of the plurality of microphones, to replace at least one of the first set of microphones or the second set of microphones in an instance in which interference is detected affecting the first frequency band or the second frequency band.

35. The computer program product of claim 31, wherein:

the at least one beamformer parameter comprises one or more beamformer filter coefficients.

36. The computer program product of claim 31, wherein:

select the first set of microphones further comprises selecting the first set of microphones comprising a large mutual distance, that exceeds a threshold distance, between the microphones of the first set for the first frequency band, comprising a low frequency band that is below a frequency threshold.

37. The computer program product of claim 36, wherein:

select the second set of microphones further comprises selecting the second set of microphones comprising a small mutual distance, that is below the threshold distance, between the microphones of the second set for the second frequency band, comprising a high frequency band that is greater than or equal to the frequency threshold.

38. The computer program product of claim 37, wherein:

the threshold distance comprises a distance of ten centimeters.

39. The computer program product of claim 37, wherein:

the microphones of the first set, comprising the large mutual distance between the microphones of the first set, provide a higher level of directionality for audio recordings than the microphones of the second set, comprising the small mutual distance between the microphones of the second set.

40. The computer program product of claim 37, further comprising:

program code instructions configured to utilize the microphones of the first set in the low frequency band and the microphones of the second set in the high frequency band to support a hands-free telephony application or another audio processing application.

41. The computer program product of claim 40, further comprising:

program code instructions configured to block low frequency disturbance in a null direction of the output signal for the assigned at least one beam direction.

* * * * *